United States Patent [19]

Tsuji

[11] Patent Number: 4,719,996

[45] Date of Patent: Jan. 19, 1988

[54] GROUP SUPERVISION APPARATUS FOR ELEVATOR

[75] Inventor: Shintaro Tsuji, Nagoya, Japan

[73] Assignee: Mitsubishi Denki Kabushiki Kaisha, Japan

[21] Appl. No.: 804,180

[22] Filed: Dec. 3, 1985

[30] Foreign Application Priority Data

Dec. 5, 1984 [JP] Japan ..... 59-256920

[51] Int. Cl.[4] ..... B66B 1/18

[52] U.S. Cl. ..... 187/127

[58] Field of Search ..... 187/29 R, 127

[56] References Cited

U.S. PATENT DOCUMENTS 4,030,571 6/1977 Kaneko et al. ..... 187/29 R
4,244,450 1/1981 Umeda et al. .
4,411,337 10/1983 Schröder et al. ..... 187/29 R

FOREIGN PATENT DOCUMENTS 50-149041 11/1975 Japan .
51-23932 2/1976 Japan .
53-55847 5/1978 Japan .
55-21709 6/1980 Japan .
57-51668 3/1982 Japan .

*Primary Examiner*—William M. Shoop, Jr.
*Assistant Examiner*—Richard Blum
*Attorney, Agent, or Firm*—Leydig, Voit & Mayer

[57] ABSTRACT

A group supervision apparatus for an elevator has apparatus operating under program control to predict periods of time of service by respective cages and to calculate predicted service periods of time, to calculate a mean value and a variance of the predicted service periods of time as to each of the cages, to set a reference value for deciding whether the service periods of time are long or short, to obtain a square value of a difference between the reference value and the mean value, to calculate a value of a ratio between the variance and the square value and to calculate an assignment estimation value on the basis of the value of the ratio in conformity with a predetermined assignment estimation function which becomes a monotonically increasing function of the ratio, to preferentially select a cage as to which the assignment estimation value is smaller, and to assign the selected cage to a hall call.

5 Claims, 25 Drawing Figures

34

GROUP SUPERVISION APPARATUS FOR ELEVATOR

BACKGROUND OF THE INVENTION

This invention relates to a group supervision apparatus for an elevator which allots hall calls to the cages of the elevator.

In group-supervisory elevators, in each of which a plurality of elevator cages are supervised as one group, there is what is termed the 'assignment system' wherein when a hall call has been registered, a cage most suited to respond to the hall call is selected and is assigned to the hall call.

The assignment system is usually so constructed that the predicted value of the waiting period of time (hereinbelow, this value shall be termed the 'predicted waiting time') of each hall call is calculated, that an assignment estimation value is obtained for each of the cage assignments from the predicted waiting time in accordance with a predetermined assignment estimation function so as to select the assignment estimation value which provides the most effective operation.

It has heretofore been common practice that the waiting times of hall calls and the like are actually measured in a building in which an elevator is operating so as to decide from the measured results whether the elevator is operating effectively. The most common approach is a decision which is based on the mean waiting time and the rate of occurrence of long waits (the proportion of hall calls having a waiting time of at least 60 seconds). As the mean waiting time is shorter and as the rate of occurrence of long waits is smaller, the elevator performs more effectively. Further, it is a recent trend that more importance is attached to the rate of occurrence of long waits than to the mean waiting time.

In some buildings (for example, a hotel and an office building, a riding time (time required for a person to reach a destination floor since getting on a cage), a service completion time (time required for the person to reach the destination floor since entering a hall), and the like, are handled as objects to-be-estimated in addition to the waiting time of the hall call.

In consideration of such performance criteria, various assignment systems have hitherto been proposed. The estimation functions in these assignment systems are often categorized in accordance with their characteristics and defined as follows:

(a) Estimation function intended to minimize the maximum value of the waiting time of hall calls.

This corresponds to, for example, a system described in Japanese Patent Application Laid-open No. 50-149041, wherein the longest predicted waiting time of an allotted hall call is evaluated for each of a plurality of cages, and a cage having a minimum waiting time is preferentially assigned.

(b) Estimation function intended to minimize the mean value of the waiting time of hall calls.

This corresponds to, for example, a system described in Japanese Patent Application Laid-open No. 51-23932, wherein the summation or mean value of the predicted waiting times of all allotted hall calls are obtained, and a cage with a minimum waiting time is assigned.

(c) Estimation function intended to concentrate the distribution of the waiting time of hall calls in a predetermined reference waiting time, namely, to minimize the variance of the waiting time.

This corresponds to, for example, a system described in Japanese Patent Application Publication No. 55-21709 (Japanese Patent Application Laid-open No. 52-18655), wherein the deviation between the predicted waiting time of a hall call and a preset reference waiting time is calculated, and a cage having a smaller deviation is preferentially assigned. In another system described in Japanese Patent Application Laid-open No. 57-51668, a predicted waiting time is weighted according to a function by which an assignment estimation value is minimized when the predicted waiting time is equal to a reference value, and a cage having a minimum assignment estimation value is assigned.

(d) Estimation function intended to minimize the mean value of the mental waiting time (which correspond to the degree of impatience) of passengers waiting in halls.

This corresponds to, for example, a system described in Japanese Patent Application Laid-open No. 53-55847, wherein the predicted waiting times of hall calls are weighted accordance with their duration (for example, a longer waiting time is weighted more), and a cage with a minimum summation or mean value is assigned.

In considering an assignment system adapted to reduce the rate of occurrence of long waits by allotting with the hall calls using the mean value of the waiting time as described in the prior-art assignment system (b), the variance thereof sometimes enlarges in spite of the diminished mean value, and it has been difficult to say that the rate of occurrence of long waits is always reduced. To the contrary, with the hall call allotment wherein the variance of the waiting time is diminished as in the prior-art assignment system (c), the mean value thereof sometimes enlarges in spite of the diminished variance, and it has also been difficult to say that the rate of occurrence of long waits is reduced. The same applies to the prior-art assignment systems (a) and (d). In conclusion, each of the priori-art assignment systems (a)–(d) controls the allotment of hall calls with emphasis taken only on one of factors determining the distribution of the waiting time, such as the maximum waiting time, the mean value and the variance, so that it has not always reduced the rate of occurrence of long waits.

SUMMARY OF THE INVENTION

This invention has the objective eliminate the problem as stated above, and has for its main object to provide a group supervision apparatus for an elevator wherein hall calls are allotted so as to minimize service time by maximizing service performance in terms of the length of time, such as waiting time, riding time or service completion time, to reduce the rate of occurrence of long waits hall calls are allotted on the basis of an assignment estimation function which estimates the rate of occurrence of long waits of the service time.

A group supervision apparatus for an elevator according to this invention comprises means to tentatively allot registered hall calls to respective cages and to calculate, based on the tentative cage allotments, predicted service times required for the allotted cage to serve the passengers, means to calculate a mean value and a variance of the predicted service times for each of the tentative cage allotments, means to set a reference time value on the basis of the predicted service times, means to obtain a square value of a difference between the reference time value and the mean value of the predicted service times and calculate a ratio of the variance relative to the square value corresponding to each of the tentative cage allotments and further to convert the calculated basis of the value of the ratio in accordance with a predetermined assignment estimation function which is monotonically increasing so as to calculate an assignment estimation value for each of the cage allotments, and means to assign a cage assignment value to serve passengers.

The group supervision apparatus for an elevator in this invention determines the assignment estimation value for estimating the rate of occurrence of long waits on the basis of the long wait reference value and the mean value and variance of the predicted service time of elevator cages and assigns a cage to a hall call in accordance with the determined assignment estimation value. Therefore, it has the function of reducing the rate of occurrence of long waits.

BRIEF DESCRIPTION OF THE DRAWINGS

FIGS. 1–17 show an embodiment of this invention, wherein

FIG. 1 is a general arrangement diagram,

FIGS. 2 and 3 are explanatory diagrams showing the distribution of the waiting periods of time of hall calls, FIG. 4 is a block diagram showing a general arrangement in the concrete, FIG. 5 shows memory maps, FIG. 6 is an explanatory diagram showing traffic volumes in respective time zones, FIGS. 7–16 are flow diagrams of programs in which FIG. 7 shows a group supervision main program, FIG. 8 a hall call registration and allotment cancellation program, FIG. 9 a hall call continuation time calculation program, FIG. 10 a long wait reference value setting program, FIG. 11 a hall call selection program, FIG. 12 an expected arrival time calculation program, FIG. 13 a predicted waiting time calculation program, FIG. 14 a predicted time-mean value and variance calculation program, FIG. 15 an assignment estimation value calculation program, and FIG. 16 an assigned cage selection program, and FIG. 17 is an explanatory diagram showing the states of cages and calls.

FIGS. 18–20 show another embodiment of this invention, wherein FIG. 18 shows memory maps, FIG. 19 is a flow diagram of a hall call continuation time calculation program, and FIG. 20 is a flow diagram of a long wait reference value setting program.

FIGS. 21–24 show still another embodiment of this invention, wherein

FIG. 21 is an explanatory diagram showing the distribution of the waiting periods of time of hall calls, FIG. 22 shows memory maps, FIG. 23 is a flow diagram of a long wait reference value setting program, and FIG. 24 is a flow diagram of an assignment estimation value calculation program.

In the drawings, the same symbols indicate identical or corresponding portions.

DESCRIPTION OF THE PREFERRED EMBODIMENTS

Now, an embodiment of this invention will be described with reference to FIGS. 1–17.

Figure 1:
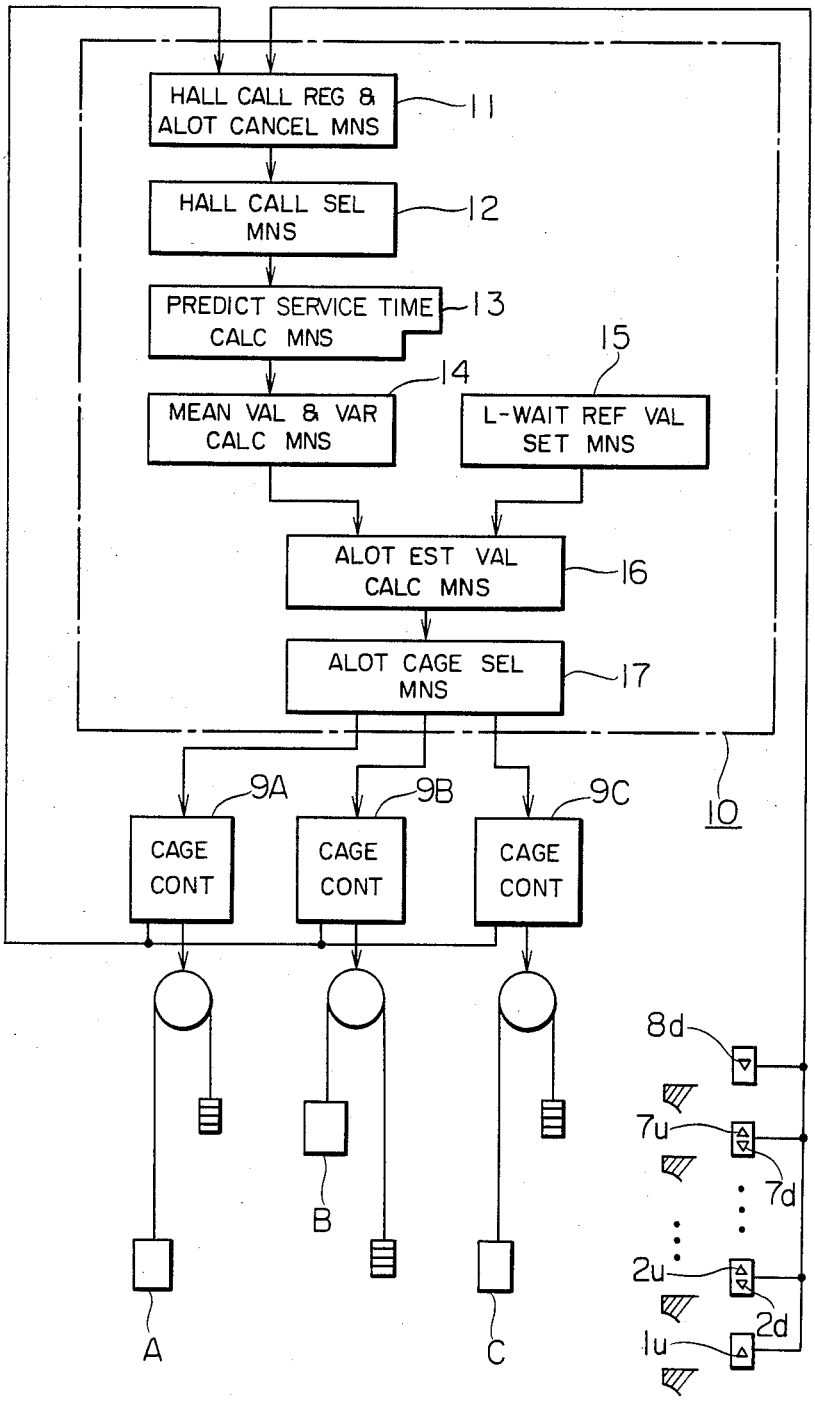

FIG. 1 is a general arrangement diagram for clearly showing the arrangement of one embodiment of a group supervision apparatus for an elevator according to this invention. In an eight-storey building, three cages A (=cage No. 1), B (=cage No. 2) and C (=cage No. 3) are installed. The first floor–seventh floor are furnished with up buttons 1*u*–7*u* for registering up calls, while the second floor–eighth floor are furnished with down buttons 2*d*–8*d* for registering down calls. Cage controllers 9A–9C disposed in a machine room control the operations of registering and cancelling cage calls, the operations of opening and closing doors, the operations of responses (such as the operations of settting traveling directions, and the operations of running and stopping cages) to calls (cage calls and allotted hall calls), etc. of the respective cages A, B and C. A group supervision apparatus 10 which is also disposed in the machine room is constructed of hall call registration and allotment cancellation means shown as program block 11 to register and cancel hall calls and also decide the cancellation of hall call allotments on the basis of input signals from the up buttons 1*u*–7*u* and the down buttons 2*d*–8*d* and hall call cancelling commands from the cage controllers 9A–9C, hall call selection means shown as program block 12 to select one hall call which is not allotted to any cage yet, predicted service time calculation means 13 to predict the waiting time of the hall calls in the case of tentatively allotting the selected hall call to the respective cages and to calculate the predicted waiting time, waiting time-mean as a program block value and variance calculation means 14 to calculate the mean values and variances of the predicted waiting times in the case of tentatively allotting the selected hall call to the respective cages, long wait reference value setting means shown as a program block 15 to set reference values for deciding whether or not the hall calls lead to long waits, assignment estimation value calculation means shown as a program block 16 to calculate assignment estimation values for estimating rates of occurrence of the long waits on the basis of the mean values, the variances and the reference values in the case of tentatively allotting the selected hall call to the respective cages, and assigned cage selection means shown as a program block 17 to assign the cage as to which the assignment estimation value becomes a minimum, to the selected hall call in order to give the cage controllers 9A–9C the commands of the hall calls to be respectively responded to.

Here, a method of calculating an assignment estimation value for estimating the rate of occurrence of long waits will be outlined.

FIG. 2 shows an example of the distribution of the waiting time of hall calls. a denotes the mean value of the waiting time, and $l_O$ the reference value of the long waits (subjected to $l_O \geqq 2a$). The rate of occurrence of long waits, L (a value which corresponds to the area of a hatched part in FIG. 2) is defined as the proportion of hall calls whose waiting time exceeds the long wait reference value $l_O$. Letting p(x) denote the probability density function of the waiting time x ($x \geqq 0$), the mean value a and variance $b^2$ of the waiting time and the rate of occurrence L of long waits can be respectively expressed as follows, subject to $$\int_0^\infty p(x)dx = 1$$

$$a = \int_0^\infty xp(x)dx \quad (1)$$

$$b^2 = \int_0^\infty (x-a)^2 p(x)dx \quad (2)$$

$$L = 1 - \int_0^{l_0} p(x)dx \quad (3)$$

$$= \int_{l_0}^\infty p(x)dx \text{ (for } l_0 \geqq 2a)$$

Meanwhile, according to the Tchebycheff inequality, it is known that when the mean of a random variable X is denoted by M, the variance thereof by $D^2$ and an arbitrary plus number by R as indicated in FIG. 3, the probability $P[|X-M|>R\cdot|D|]$ at which $|X-M|>R\cdot|D|$ holds (the probability is a value corresponding to the area of hatched parts in FIG. 3) becomes as given by Eq. (4):

$$P[\,|X-M| > R\cdot|D|\,] \leqq \frac{1}{R^2} \quad (4)$$

This equation (4) is applied to Eq. (3), and the reference value is put:

$$l_0 = a + R\cdot|b| \left(\text{for } R \geqq \frac{a}{b}\right) \quad (5)$$

Then, the following inequality 6 holds for the rate of occurrence L of long waits:

$$L = \int_{l_0}^\infty p(x)dx \leqq \frac{1}{R^2} = \frac{b^2}{(l_0-a)^2} \quad (6)$$

The right-hand side $$\frac{b^2}{(l_O-a)^2}$$

of the above equation (6) is to be called the "upper limit value of the rate of occurrence L of long waits", and it is indicated that when the long wait reference value $l_O$ is given, the rate of occurrence L of long waits becomes, at least, smaller than $$\frac{b^2}{(l_O-a)^2}$$

for an arbitrary distribution of waiting time. Accordingly, when hall calls are allotted so as to afford the mean value $a_O$ and the variance $b_O^2$ which minimize the upper limit value $$\frac{b^2}{(l_O-a)^2},$$

the minimization of the rate of occurrence L of long waits can be achieved. With the hall call allotment system in the prior art wherein merely the variance $b^2$ is minimized or wherein merely the mean value a is minimized, the rate of occurrence of long waits cannot be minimized.

The present embodiment employs the right-hand side of the inequality (6) as an assignment estimation function f. That is:

$$f = \frac{b^2}{(l_o-a)^2} \quad (7)$$

The mean value a and the variance $b^2$ are calculated by the following equations (8) and (9):

$$a = \frac{1}{m}\sum_{i=1}^{m} x_i \quad (8)$$

$$b^2 = \frac{1}{m}\sum_{i=1}^{m} (a-x_i)^2 \quad (9)$$

where m denotes the number of hall calls, and $x_i$ (i=1, 2, . . . , m) the waiting time of the hall calls.

Figure 4:
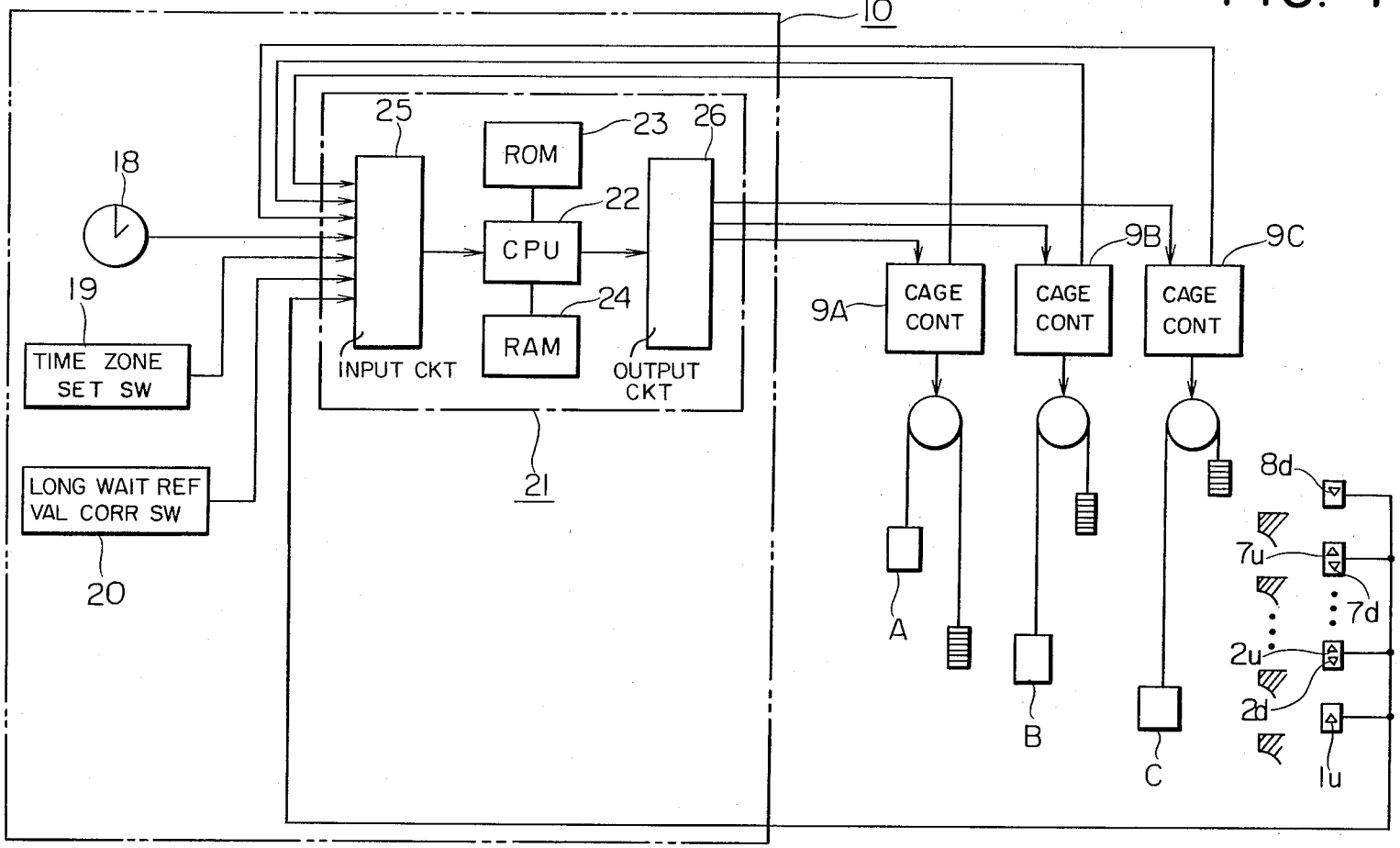

FIG. 4 is a system arrangement diagram of the embodiment in FIG. 1. In the diagram, numeral 18 indicates a clock which is disposed in the group supervision apparatus 10 and delivers a time signal, numeral 19 a time zone setting switch which similarly delivers a boundary time signal for time zones, numeral 20 a long wait reference value correction switch which similarly delivers a signal for correcting a long wait reference value, and numeral 21 a microcomputer similarly disposed, which has a CPU 22, a ROM 23, a RAM 24, an input circuit 25 and an output circuit 26. The microcomputer 21 carries out the group supervision functions by operating under program control of programs stored in the ROM 23 and RAM 24, the program blocks being outlined in the flow chart of FIG. 7.

FIG. 5 is a diagram showing memory maps in the ROM 21 and the RAM 24. $T_0$ in the figure denotes data which indicates a calculation cycle for executing a group supervision program shown in FIG. 7, and which is set as 1 (second). $T_1$ and $T_2$ denote data items of fixed values which are used when calculating the predicted values of time required for the cage to run from a current position to the halls of respective floors (hereinbelow, the predicted values shall be termed 'expected arrival times'). The data $T_1$ expresses time required for one stop, while the data $T_2$ expresses time required for one floor travel, and they are respectively set as 10 (seconds) and 2 (seconds). F denotes fixed values data which expresses the number of stop floors and which is set as 8 (floors), and N denotes fixed value data which expresses the number of cages and which is set as 3 (cages).

i denotes data which expresses the numbers of halls set in correspondence with hall buttons (for individual directions), and which is as listed in Table 1. j denotes data which similarly expresses hall numbers, and which expresses a hall ahead of hall No. i by one floor.

TABLE 1

| Hall No. | Direction | | | | | | | | | | | | | |
|---|---|---|---|---|---|---|---|---|---|---|---|---|---|---|
| | Up Direction | | | | | | | Down Direction | | | | | | |
| | Floor | | | | | | | | | | | | | |
| | 1 | 2 | 3 | 4 | 5 | 6 | 7 | 8 | 7 | 6 | 5 | 4 | 3 | 2 |
| i | 1 | 2 | 3 | 4 | 5 | 6 | 7 | 8 | 9 | 10 | 11 | 12 | 13 | 14 |

k denotes data which expresses cage number, $L_0$ denotes data which expresses a long wait reference value, TIME denotes data which is input from the clock 18 through the input circuit 25 and which expresses a time, and $B_1$–$B_3$ denote data items which are similarly input from the time zone setting switch 19 and which express the start times of respective time zones $P_1$–$P_3$ in the case of dividing one day into the three time zones $P_1$, $P_2$ and $P_3$ in accordance with traffic volumes as shown in FIG. 6. $M_1$–$M_3$ and G indicate data items which are similarly input from the long wait reference value correction switch 20, and the data items $M_1$–$M_3$ express the presumed values of mean waiting time in the respective time zones $P_1$–$P_3$, while the data G expresses a coefficient for setting the long wait reference value $L_0$ on the basis of the mean waiting time. HB(i) (i=1, 2, . . . , 14) indicates hall button data items which correspond to the up buttons **1*u*–7*u* and the down buttons 8*d*–2*d* respectively, which are input through the input circuit 25 and which are set to "1" when the hall buttons are depressed and to "0" when not. CP(k) (k=1, 2, 3) indicates data items which are respectively input from the cage controllers 9A–9C of the cages Nos. 1–3 through the input circuit 25, which correspond to the positions of the cages and which are set in consideration of the running directions of the cages likewise to hall Nos. i listed in Table 1. When the cages have no direction, the data items CP(k) are set as in the case of the up direction. CR(k) (k=1, 2, 3) indicates data items which are similarly input from the respective cage controllers 9A–9C**, which correspond to hall call cancellation commands and which numbers of hall calls to be cancelled (similar to hall Nos. i listed in Table 1) when the hall call cancellation is valid (that is, a hall call in the running direction of the cage cannot be registered during a period from a time at which the stop of the cage at a floor has been determined, to a time at which the cage starts from the floor). When the hall call cancellation is invalid, the data CR(k) becomes "0".

CC(k, i) (k=1, 2, 3; i=1, 2, . . . , 14) indicates data items which are similarly input from the respective cage controllers 9A–9C, which correspond to cage calls and which are set in consideration of the running directions of the cages likewise to hall Nos. i listed in Table 1. This data is set to "1" when the cage call is registered, and to "0" when not.

HC(i) (i=1, 2, . . . , 14) indicates data items which express the registration situations of the respectively corresponding hall calls and which are set to "0" when the hall calls are not registered, to "1" when they are registered but are not allotted to any cages, and to "2" when they are registered and are allotted to any of the cages.

TC(i) (i=1, 2, . . . , 14) indicates data items which express the continuation time of the respectively corresponding hall calls (=time elapsed since the hall calls have been registered), TW(i) (i=1, 2, . . . , 14) indicates data items which express the predicted waiting time of the respectively corresponding hall calls, and TA(k, i) (k=1, 2, 3; i=1, 2, . . . , 14) indicates data items which express the expected time of the arrivals of the respective cages Nos. 1–3 at the corresponding halls. AS(k, i) (k=1, 2, 3; i=1, 2, . . . , 14) indicates data items which express the assignments of the respective cages Nos. 1–3 to the corresponding hall calls, and which are set to "1" when the cages are assigned and to "0" when not. The assignment data items AK(k, i) are delivered to the respective cage controllers 9A–9C through the output circuit 26.

$I_O$ indicates data which stores No. of a hall call to be allotted (similar to hall No. i indicated in Table 1), and as which "0" is set when there is no hall call to be allotted. $K_O$ indicates data which stores No. of the cage which is assigned when the hall call to be allotted $I_O$ is tentatively allotted, and HN indicates data which expresses the number of hall calls presently registered.

AV(k) (k=1, 2, 3) denotes data items which express the mean values of the predicted waiting time of the hall calls presently registered, in the case where the hall call to be allotted $I_O$ is tentatively allotted to the cages of the respective cage Nos. k, CV(k) (k=1, 2, 3) denotes data items which express the variances of the predicted waiting time of the hall calls similarly, and EV(k) (k=1, 2, 3) denotes data items which express assignment estimation values similarly. v indicates accumulation data items which are temporarily set when the mean values AV(k) and the variances CV(k) are calculated, and y and z indicate data items which are temporarily set when the assigned cages are selected on the basis of the assignment estimation values EV(k) and which express the number of the cage having the minimum assignment estimation value and the minimum assignment estimation value at that time, respectively.

Next, the operation of the embodiment will be described with reference to FIGS. 7–17.

Figure 7:
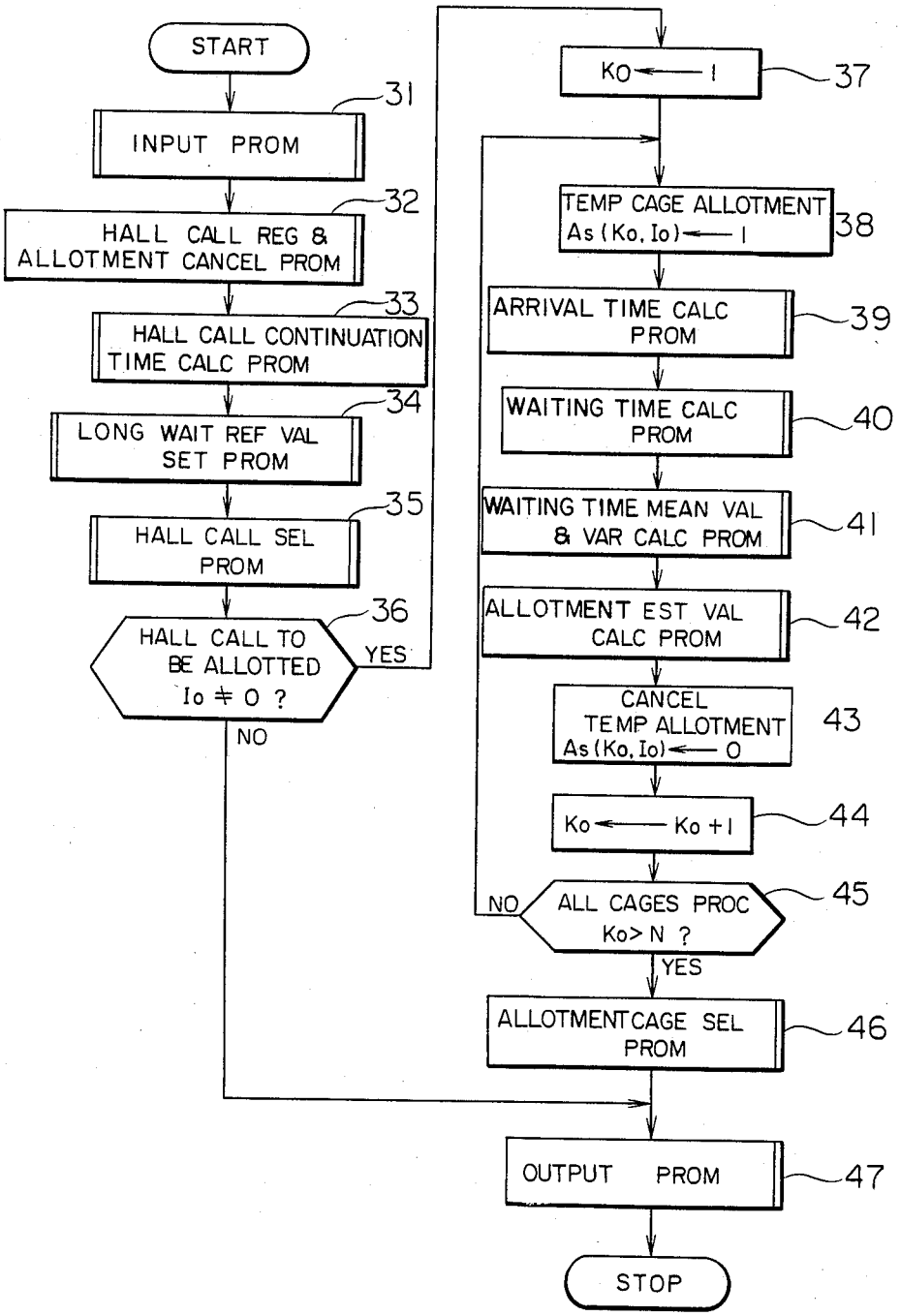

FIG. 7 is a flow chart showing the whole group supervision program which is stored in the ROM 23 of the microcomputer 21, FIGS. 8–16 are flow charts showing subprograms in FIG. 7, and FIG. 17 is a diagram showing the relationship between cages and calls for illustrating a concrete example of the allotments of hall calls.

The microcomputer 21 (FIG. 4) operates under control of the group supervision program shown in FIG. 7 to carry out the functions of a group supervisory apparatus. Following receipt of input data under control of the input program referred to in program block 31 of FIG. 6, the microcomputer under program control referred to in program blocks 32–40 provides means to tentatively allot the registered hall calls and calculates predicted service times of the allotted cages. Accordingly, the program blocks 31–47 of the group supervision program shown in FIG. 7 are executed in every calculation cycle $T_O$ (=1 second). First, in the input program of the program block 31, signals are input from the hall buttons **1*u*–7*u* and 2*d*–8*d*, cage controllers 9A–9C, clock 18, time zone setting switch 19 and long wait reference value correction switch 20 through the input circuit 25**, to set the hall button data HB(i) (i=1, 2, . . . , 14), cage call data CC(k, i) (k=1, 2, 3; i=1, 2, . . . , 14), cage position data CP(k) (k=1, 2, 3), hall call cancellation command data CR(k) (k=1, 2, 3), time data TIME, start time data $B_1$–$B_2$, mean waiting time-presumption value data $M_1$–$M_3$ and coefficient data G.

Subsequently, in the hall call registration and allotment cancellation program block 32, the registration and cancellation of hall calls are decided and the cancellation of allotments is decided on the basis of the hall call cancellation command data CR(k) (k=1, 2, 3) and hall button data HB(i) (i=1, 2, . . . , 14). Now, this processing program block will be described in detail with reference to FIG. 8.

At a step 51, the hall No. i is initialized to "1". Thenceforth, the processes of steps 52–64 are repeated for all the hall Nos. i=1, 2, . . . , 14. The cage No. k is initialized to "1" at the step 52, and if the commands of cancelling the hall calls of the hall Nos. i are issued is decided by the repetition of the steps 52–55. If, as to any of the cages Nos. 1–3, the hall call cancellation command is issued for the hall call of the hall No. i, the cancellation command data CR(k)=i holds at the step 53. Therefore, the control flow proceeds to the step 58, at which the hall call data HC(i) is set to "0". Subsequently, the cage No. k is initialized to "1" at the step 59, whereupon all the assignment data items AS(k, i) (k=1, 2, 3) of the hall No. i are set to "0" for the cages Nos. 1–3 by the repetition of the steps 60–62. Whenever, as to even any of the cages Nos. 1–3, the hall call cancellation command is not issued for the hall call of the hall No. i, the cancellation command data CR(k)≠i holds at the step 53. Therefore, the processes of the steps 53–55 are repeated for the cages Nos. 1–3, whereupon the control flow proceeds to the step 56. This step 56 decides if the hall button of the hall No. i is depressed.

If the hall button is depressed, the hall button data HB(i)=1 holds, so that the control flow proceeds to the step 57, at which the hall call data HC(i) is set to "1". The step 63 counts up the hall No. i by "1", and the step 64 decides whether or not the processes have ended for all the floors. If the processes have not ended, the control flow returns to the step 52, and similar processes are executed as to the next hall No. i. When the processes have ended for all the halls, the process of the hall call registration and allotment cancellation program block 32 ends.

When the process of the hall call registration and allotment cancellation program block 32 has ended, the continuation of time of hall calls are subsequently calculated in the hall call continuation time calculation program block 33 in FIG. 7. Now, this processing program block will be described in detail with reference to FIG. 9.

At a step 71, the hall No. i is initialized to "1". Thenceforth, the processes of steps 72–76 are repeated for all the hall Nos. i=1, 2, . . . , 14. The step 72 decides whether or not the hall call of the hall No. i is registered. If the hall call is not registered, the hall call data HC(i) is "0", so that the control flow proceeds the step 74, at which the hall call continuation time data TC(i) is set to "0". If the hall call is registered, the hall call data HC(i) is "1" or "2", so that the step 72 is followed by the step 73, at which the hall call continuation time data TC(i) is counted up by the calculation cycle $T_O$ (=1 second). At the step 75, the hall No. i is counted up by "1". At the step 76, whether or not the processes have ended for all the halls is decided. If the processes have not ended, the control flow returns to the step 72, and similar processes are executed as to the next hall No. i. When the processes have ended for all the halls, the process of the hall call continuation time calculation program block ends.

When the process of the hall call continuation time calculation program block 33 has ended, a long wait reference value corresponding to a time zone is subsequently set in the long wait reference value setting program block 34 in FIG. 7. Now, this processing program block will be described in detail with reference to FIG. 10.

It is assumed that the start times $B_1$, $B_2$ and $B_3$ of the time zones $P_1$, $P_2$ and $P_3$ be respectively set as 00:00, 9:00 and 20:00 by the time zone setting switch 19, that the presumptive values $M_1$, $M_2$ and $M_3$ of the mean waiting time in the time zones $P_1$, $P_2$ and $P_3$ be respectively set as 5 seconds, 20 seconds and 10 seconds by the long wait reference value correction switch 20, and that the coefficient G be set as 3.

When the time data TIME has become 00:00, the control flow proceeds from the step 81 to the step 82, at which the long wait reference value data $L_O$ is set as $5\times3=15$ (seconds) on the basis of the presumptive value $M_1$ of the mean waiting time in the time zone $P_1$ and the coefficient G. Then, the process of the long wait reference value setting program 34 ends. When the time data TIME has become 9:00 upon further lapse of time, the control flow proceeds along steps 81→83→84, and the long wait reference value data $L_O$ in the time zone $P_2$ is similarly set as $20\times3=60$ (seconds) at the step 84. When the last time zone $P_3$ has been reached, that is, when the time data TIME has become 20:00, the control flow proceeds along steps 81→83→85→86, at which the long wait reference value data $L_O$ is set as $10\times3=30$ (seconds). At any time other than the start times of the respective time zones, the control flow proceeds along the steps 81→83→85→exit, and the content of the long wait reference value data $L_O$ is not changed.

When the process of the long wait reference value setting program block 34 has ended, one hall call to be allotted is subsequently selected from among hall calls not allotted to any of the cages, in the hall call selection program block 35 in FIG. 7. Now, this program block will be described in detail with reference to FIG. 11.

At a step 91, the hall No. i is initialized to "1". Thenceforth, the processes of steps 92–94 are repeated as to all the hall Nos. i=1, 2, . . . , 14. In the course, the step 92 decides whether or not the hall call of the hall No. i has been allotted. If, at the step 92, the hall call of the hall No. i is registered and is not allotted to any of the cages, the hall call data HC(i) is "1". Therefore, the control flow proceeds to a step 96, at which the hall No. i on this occasion is stored as the data $I_O$ of the hall call to be allotted, and processes concerning the remaining hall Nos. i+1, i+2, . . . are stopped. Then the process of the hall call selection program block 35 ends.

On the other hand, if the hall call is not registered (HC(i)=0) or if it is registered but is already allotted (HC(i)=2), the control flow proceeds from the step 92 to the step 93, which counts up the hall No. i by "1", and then to the step 94, which decides whether or not the processes have ended for all the halls. If they have not ended yet, the control flow returns to the step 92 so as to execute similar processes as to the next hall No. i. When the processes have ended as to all the halls, the control flow proceeds to a step 95, at which the data $I_O$ of the hall call to be allotted is set to "0" in order to indicate that there was not a hall call to be allotted. Then, the process of the hall call selection program 35 ends.

When the process of the hall call selection program block 35 has ended, whether or not the hall call to be allotted has been selected is subsequently decided at the program block 36 in FIG. 7. In the absence of the hall call to be allotted, $I_O=0$ holds, and hence, the control flow proceeds to the program block 47. In the output program of the program block 47, the assignment data items AS(k, i) (k=1, 2, 3; i=1, 2, . . . , 14) set by the calculation of this time are delivered to the cage controllers 9A–9C through the output circuit 26. Then, processes in the calculation cycle of this time end.

In the presence of the hall call to be allotted, the control flow proceeds from the program block 36 to the program block 37, at which the tentatively assigned cage No. $K_O$ is initialized to "1". Thenceforth, the processes of the program blocks 38–45 are repeated for all the tentatively assigned cage Nos. $K_O$=1, 2 and 3. At the program block 38, the assignment data AS($K_O$, $I_O$) of the cage of the tentative assignment No. $K_O$ corresponding to the hall call to be allotted $I_O$ is set to "1". Thus, until the assignment data AS($K_O$, $I_O$) is set to "0" again at the program block 43, that is to say, at the program blocks 39–42, the predicted waiting time of hall calls as well as the mean values and variances thereof and also the assignment estimation values based on them are calculated assuming that the hall call to be allotted $I_O$ be allotted to the cage No. $K_O$.

When the tentative assignment at the program block 38 has ended, periods of time required for the cages to reach the halls are subsequently calculated predicted on the expected arrival time calculation program block 39. Now, this processing program block will be described in detail with reference to FIG. 12.

At a step 101, the cage No. k is initialized to "1". Thenceforth, the processes of steps 102–113 are repeated for all the cage Nos. k=1, 2 and 3, to calculate the expected arrival time data TA(k, i) as to the respective cages.

In the present embodiment, the expected arrival periods of time are successively calculated assuming that each cage be run in the traveling direction thereof and through all the floors from the hall of a cage position where the cage lies.

At the step 102, as to the cage No. k, the cage position data CP(k) is set to hall No. i as a hall to be calculated first, the expected arrival time data TA(k, i) for the cage position hall is set to "0", and the hall No. j of the next floor is initialized to i+1. At the step 103, the hall No. j of the next floor is decided. When the hall No. j is smaller than 15, the control flow proceeds to the step 105, and when the hall No. j=15 holds, the step 104 corrects the hall No. to j=1 and is followed by the step 105. Thus, the start of the calculation of the expected arrival time ready ready. Thenceforth, the processes of the steps 105–111 are repeated for all the hall Nos. j. The step 105 decides whether or not the cage stops at the hall of the hall No. i. If the hall of the hall No. i has a cage call (CC(k, i)=1) or an allotted hall call (AS(k, i)=1), the control flow proceeds to the step 107. Here, the time $T_1$ (=10 seconds), which corresponds to a stopping time at the hall of the hall No. i, and the time $T_2$ (=2 seconds), which corresponds to a traveling time from the hall of the hall No. i to the hall of the hall No. j (the hall next to the hall No. i), are added to the expected arrival period of time TA(k, i) to the hall of the hall No. i, whereby the expected arrival time TA(k, j) of the hall of the hall No. j is calculated. If the hall of the hall No. i has neither a cage call nor an allotted hall call (CC(k, i)=0 and AS(k, i)=0), the control flow proceeds to the step 106. Here, the time $T_2$ (=2 seconds) which corresponds to the traveling time from the hall of the hall No. i to the hall of the hall No. j is added to the expectative arrival time TA(k. i) to the hall of the hall No. i, whereby the expected arrival time TA(k, j) of the hall of the hall No. j is calculated. The control flow proceeds from the step 107 or 106 to the step 108, at which each of the hall Nos. i and j is counted up by one. The steps 109 and 110 corrects the hall No. j likewise to the steps 103 and 104, and the step 111 decides whether or not the processes have ended for all the halls. If they have not ended, the control flow proceeds to the step 105, whereupon similar processes are executed as to the next hall Nos. i and j. When the processes have ended for all the halls, the control flow proceeds to the step 112, which counts up the cage No. k by "1". The step 113 decides whether or not the processes have ended for all the cages. If they have not ended yet, the control flow returns to the step 102, whereupon similar processes are executed as to the next cage No. k. When the processes have ended for all the cages, the process of the expected arrival time calculation program 39 ends.

By way of example, when expected arrival periods of time under circumstances as illustrated in FIG. 17 are actually calculated by the expected arrival time calculation program 39 described above, they become as listed in Table 2. FIG. 17 shows the situations of the cages and calls in the time zone $P_2$. Symbols 2*u*H, 5*u*H and 7*u*H in the figure denote up calls at the first floor, fifth floor, and seventh floor, respectively, and the up call 5*u*H of the fifth floor is a hall call which has just been registered anew. Symbols 2*d*H, 3*d*H, 4*d*H, and 8*d*H denote down calls at the second floor, third floor, fourth floor, and eighth floor, respectively, and symbols 1*c*C and 8*c*A denote the cage call of the cage No. 3 for the first floor and the cage call of the cage No. 1 for the eighth floor, respectively. The cages A–C of Nos. 1–3 lie at the first floor, fourth floor, and sixth floor, respectively, and are operating in the up direction, up direction, and down direction, respectively. Further, symbols 2*u*A and 7*u*A denote the up assignments of the cage No. 1 for the second floor and seventh floor, respectively, symbol 8*d*B denotes the down assignment of the cage No. 2 for the eighth floor, and symbols 2*d*C–4*d*C denote the down assignments of the cage No. 3 for the second floor–fourth floor.

TABLE 2

| | | Expected Arrival Time | | | | | | | | | | | | | |
|---|---|---|---|---|---|---|---|---|---|---|---|---|---|---|---|
| | | Direction | | | | | | | | | | | | | |
| | | Up Direction | | | | | | | Down Direction | | | | | | |
| | | Floor | | | | | | | | | | | | | |
| | | 1F | 2F | 3F | 4F | 5F | 6F | 7F | 8F | 7F | 6F | 5F | 4F | 3F | 2F |
| | | Hall No. i | | | | | | | | | | | | | |
| | | 1 | 2 | 3 | 4 | 5 | 6 | 7 | 8 | 9 | 10 | 11 | 12 | 13 | 14 |
| for | TA(1, i) | 0 | 2 | 14 | 16 | 18 | 30 | 32 | 44 | 56 | 58 | 60 | 62 | 64 | 66 |
| $K_o$ = 1 | TA(2, i) | 32 | 34 | 36 | 0 | 2 | 4 | 6 | 8 | 20 | 22 | 24 | 26 | 28 | 30 |
| | TA(3, i) | 40 | 52 | 54 | 56 | 58 | 60 | 62 | 64 | 66 | 0 | 2 | 4 | 16 | 28 |
| for | TA(1, i) | 0 | 2 | 14 | 16 | 18 | 20 | 22 | 34 | 46 | 48 | 50 | 52 | 54 | 56 |
| $K_o$ = 2 | TA(2, i) | 42 | 44 | 46 | 0 | 2 | 14 | 16 | 18 | 30 | 32 | 34 | 36 | 38 | 40 |

TABLE 2-continued

| | | Expected Arrival Time | | | | | | | | | | | | | |
|---|---|---|---|---|---|---|---|---|---|---|---|---|---|---|---|
| | | Direction | | | | | | | | | | | | | |
| | | Up Direction | | | | | | | Down Direction | | | | | | |
| | | Floor | | | | | | | | | | | | | |
| | | 1F | 2F | 3F | 4F | 5F | 6F | 7F | 8F | 7F | 6F | 5F | 4F | 3F | 2F |
| | | Hall No. i | | | | | | | | | | | | | |
| | | 1 | 2 | 3 | 4 | 5 | 6 | 7 | 8 | 9 | 10 | 11 | 12 | 13 | 14 |
| | TA(3, i) | 40 | 52 | 54 | 56 | 58 | 60 | 62 | 64 | 66 | 0 | 2 | 4 | 16 | 28 |
| for | TA(1, i) | 0 | 2 | 14 | 16 | 18 | 20 | 22 | 34 | 46 | 48 | 50 | 52 | 54 | 56 |
| $K_o = 3$ | TA(2, i) | 32 | 34 | 36 | 0 | 2 | 4 | 6 | 8 | 20 | 22 | 24 | 26 | 28 | 30 |
| | TA(3, i) | 40 | 52 | 54 | 56 | 58 | 70 | 72 | 74 | 76 | 0 | 2 | 4 | 16 | 28 |

When the process of the expected arrival time calculation program 39 has ended, the predicted waiting periods of time of the respective hall calls are subsequently calculated in the predicted waiting time calculation program block 40 in FIG. 7. Now, this processing program block will be described in detail with reference to FIG. 13.

At a step 121, the hall No. i is initialized to "1". Thenceforth, the processes of steps 122–129 are repeated for all the hall Nos. i=1, 2, . . . , 14. The cage No. k is initialized to "1" at the step 122, and whether or not the hall call of the hall No. i has already been allotted to the cages Nos. 1–3 is decided by the repetition of the steps 123–125. Whenever any of the cages Nos. 1–3 is not assigned to the hall call of the hall No. i, the assignment data AS(k, i)≠1 holds at the step 123. Therefore, the processes of the steps 123–125 are repeated for the cages Nos. 1–3, whereupon the control flow proceeds to the step 126. The step 126 sets the predicted waiting time TW(i) of the hall call of the hall No. i to "0", and is followed by the step 128. If any of the cages Nos. 1–3 is assigned to the hall call of the hall No. i, the control flow proceeds to the step 127 when the assignment data AS(k, i)=1 has held at the step 123. At the step 127, the expected arrival time data TA(k, i) of the assigned cage is added to the continuation time data TC(i) of the hall call of the hall No. i, and the result is set as the predicted waiting time data TW(i), whereupon the control flow proceeds to the step 128. The step 128 counts up the hall No. i by "1", and the step 129 decides whether or not the processes have ended for all the halls. If they have not ended yet, the control flow proceeds to the step 122 so as to perform similar processes for the next hall No. i. When the processes have ended for all the halls, the process of the predicted waiting time calculation program 40 ends.

By way of example, it is assumed that under the circumstances as illustrated in FIG. 17, the expected arrival time data items TA(k, i) calculated by the expected arrival time calculation program 39 be as listed in Table 2, while the continuation time data items TC(i) calculated by the hall call continuation time calculation program 33 be as listed in Table 3. Then, when the predicted waiting time of the respective hall calls are actually calculated by the predicted waiting time calculation program 40 stated above, they become as listed in Table 4.

TABLE 3

| | Hall Call Continuation Time | | | | | | | | | | | | | |
|---|---|---|---|---|---|---|---|---|---|---|---|---|---|---|
| | Direction | | | | | | | | | | | | | |
| | Up Direction | | | | | | | Down Direction | | | | | | |
| | Floor | | | | | | | | | | | | | |
| | 1F | 2F | 3F | 4F | 5F | 6F | 7F | 8F | 7F | 6F | 5F | 4F | 3F | 2F |
| | Hall No. i | | | | | | | | | | | | | |
| | 1 | 2 | 3 | 4 | 5 | 6 | 7 | 8 | 9 | 10 | 11 | 12 | 13 | 14 |
| TC (i) | 0 | 8 | 0 | 0 | 1 | 0 | 3 | 22 | 0 | 0 | 0 | 11 | 4 | 2 |

TABLE 4

| | | Hall Call-Predicted Waiting Time | | | | | | | | | | | | | |
|---|---|---|---|---|---|---|---|---|---|---|---|---|---|---|---|
| | | Direction | | | | | | | | | | | | | |
| | | Up Direction | | | | | | | Down Direction | | | | | | |
| | | Floor | | | | | | | | | | | | | |
| | | 1F | 2F | 3F | 4F | 5F | 6F | 7F | 8F | 7F | 6F | 5F | 4F | 3F | 2F |
| | | Hall No. i | | | | | | | | | | | | | |
| | | 1 | 2 | 3 | 4 | 5 | 6 | 7 | 8 | 9 | 10 | 11 | 12 | 13 | 14 |
| for $K_o = 1$ | TW(i) | 0 | 10 | 0 | 0 | 19 | 0 | 35 | 30 | 0 | 0 | 0 | 15 | 20 | 30 |
| for $K_o = 2$ | TW(i) | 0 | 10 | 0 | 0 | 3 | 0 | 25 | 40 | 0 | 0 | 0 | 15 | 20 | 30 |
| for $K_o = 3$ | TW(i) | 0 | 10 | 0 | 0 | 59 | 0 | 25 | 30 | 0 | 0 | 0 | 15 | 20 | 30 |

When the process of the predicted waiting time calculation program 40 has ended, the mean values and variances of the waiting time of hall calls are subsequently calculated on the basis of the foregoing equations ⑧ and ⑨ in the waiting time-mean value and variance calculation program block 41 in FIG. 7. The microcomputer 21 operating under control of the steps referred to in program block 41 serves as a means to calculate a mean value and a variance of the predicted service times for each of the tentative cage allotments. Now, this processing program block will be described in detail with reference to FIG. 14.

First, at a step 131, the hall call number HN is initialized to "0", the hall No. i to "1", and the accumulation data v to "0". Thenceforth, the processes of steps 132–136 are repeated for all the hall Nos. i=1, 2, . . . , 14. The step 132 decides whether or not the hall call of the hall No. i has been allotted. If it has been allotted, the hall call data HC(i)=2 holds. Therefore, the control flow proceeds to the step 133, at which the hall call number data HN is counted up by "1". At the next step 134, the predicted waiting time TW(i) of this time is added to the accumulation data v of the predicted waiting time till the preceding time, to update the accumulation data v, whereupon the control flow proceeds to the step 135. If the hall call is not allotted, the step 132 is directly followed by the step 135.

The step 135 counts up the hall No. i by "1", and the step 136 decides whether or not the processes have ended for all the halls. If they have not ended yet, the control flow returns to the step 132 so as to perform similar processes for the next hall No. i. When the processes have ended for all the halls, the control flow proceeds to a step 137, at which the accumulation data v is divided by the hall call number data HN thereby to set the mean value $AV(K_O)$ of the predicted waiting time.

Subsequently, the hall No. i is initialized to "1" and the accumulation data v to "0" at a step 138. Thenceforth, the processes of steps 139–142 are repeated for all the hall Nos. i=1, 2, . . . , 14. The step 139 decides whether or not the hall call of the hall No. i has been allotted. If it has been allotted, the hall call data HC(i)=2 holds. Therefore, the control flow proceeds to the step 140, at which the square value of the deviation between the predicted waiting time TW(i) of this time and the mean value $AV(K_O)$ is added to the accumulation data v till the preceding time, to update the accumulation data v, whereupon the control flow proceeds to the step 141. Unless the hall call has been allotted, the step 139 is directly followed by the step 141. The step 141 counts up the hall No. i by "1", and the step 142 decides whether or not the processes have ended for all the halls. If they have not ended yet, the control flow returns to the step 139 so as to perform similar processes for the next hall No. i. When the processes have ended for all the halls, the control flow proceeds to a step 143, at which the accumulation data v is divided by the hall call number data HN, to set the variance $CV(K_O)$ of the predicted waiting time. Then, the process of the mean value and variance calculation program block 41 ends.

By way of example, assuming that the predicted waiting time of the respective hall calls be calculated as listed in Table 4 under the circumstances illustrated in FIG. 17, the hall call number is HN=7 (calls), and the mean value $AV(K_O)$ and the variance $CV(K_O)$ become as listed in Table 5 owing to the mean value and variance calculation program block 41 stated above.

TABLE 5

Mean Value and Variance of Predicted Waiting Times, and Assignment Estimation Value

| | Mean Value $AV(K_o)$ | Variance $CV(K_o)$ | Assignment Estimation Value $EV(K_o)$ |
|---|---|---|---|
| for $K_o = 1$ | 22.7 | 71.35 | 0.0513 |
| for $K_o = 2$ | 20.4 | 133.96 | 0.0854 |
| for $K_o = 3$ | 27 | 218.29 | 0.2004 |

When the process of the wait time-mean value and variance calculation program block 41 has ended, the assignment estimation value is subsequently calculated on the basis of the long wait reference value $L_O$, and the mean value $AV(K_O)$ and variance $CV(K_O)$ of the waiting time in the assignment estimation value calculation program block 42 in FIG. 7.

A means to set a reference time value, to find a square value of the reference time value and the mean value of the predicted service times, to calculate a ratio of the variance relative to the square value, and to convert the calculated ratio in accordance with a predetermined assignment estimation function is provided in apparatus form by the computer 21 under control of the program block 42.

Now, this processing program block will be described in detail with reference to FIG. 15.

First, at a step 151, the number of hall calls is decided. If the number of hall calls is at least 2, the control flow proceeds to a step 152, at which $CV(K_O)/[L_O-AV(K_O)]^2$ is calculated in conformity with Eq. ⑦ expressive of the assignment estimation function and is set as the assignment estimation value $EV(K_O)$. If the number of hall calls is 1 (one), the control flow proceeds to a step 153, at which the mean value $AV(K_O)$ is set as the assignment estimation value $EV(K_O)$. This is a disposal based on the fact that, whenever there is only one hall call, the variance $CV(K_O)$ becomes "0". The mean value $AV(K_O)$ at this time becomes equal to the predicted waiting time $TW(I_O)$ of the cage No. $K_O$ tentatively assigned to the hall call to be allotted $I_O$. After all, therefore, the hall call is allotted to the cage which can respond most quickly.

Under the circumstances as illustrated in FIG. 17, it is assumed that the long wait reference value $L_O$ in, for example, the time zone $P_2$ be set as 60 seconds and that the mean values $AV(K_O)$ and the variances $CV(K_O)$ be calculated as listed in Table 5. Then, the assignment estimation values $EV(K_O)$ at this time are calculated as indicated in the same Table 5 by the above-stated assignment estimation value calculation program block 42.

When the process of the assignment estimation value calculation program block 42 has ended, the assignment data $AS(K_O, I_O)$ is set to "0" to cancel the tentative assignment at the next program block 43 in FIG. 7, the tentative assignment cage No. $K_O$ is counted up by "1" at the program block 44, and whether or not the processes have ended for all the cages is decided at the program block 45. If the processes have not ended for all the cages, the control flow returns to the program block 38 again, and similar processes are repeated as to the cage of the next tentative assignment cage No. $K_O$. When the processes have ended for all the cages, the control flow proceeds to the program block 46, at which the optimum cage is selected for the hall call to be allotted $I_O$ and is regularly assigned thereto on the basis of the assignment estimation values $EV(K_O)$ ($K_O$=1, 2, 3) by the assigned cage selection program. The microcomputer 21 operating under program control of the steps referred to in program block 46 serves as a selection means to assign a cage to serve the passengers on the basis of the assignment estimation values for all of the cage allotments. Now, this processing program block will be described in detail with reference to FIG. 16.

At a step 161, the assignment estimation value EV(1) in the case where the tentatively assigned cage is the cage No. 1 is set as the minimum value data Z, the cage No. y of the cage having the minimum assignment estimation value is initialized to "1", and the cage No. k is initialized to "2". Thenceforth, the processes of steps 162–165 are repeated for all the remaining cages k=2 and 3. At the step 162, whether or not the assignment estimation value EV(k) of the cage of the cage No. k is smaller than the minimum estimation value Z. If the former is smaller than the latter, EV(k)<Z holes, and hence, the control flow proceeds to the step 163 which updates the minimum value data Z to the assignment estimation value EV(k) and the cage No. y of the cage having the minimum estimation value to the cage No. k, and which is followed by the step 164. If the assignment estimation value EV(k) is not smaller than the minimum estimation value Z, the control flow proceeds from the step 162 to the step 164 directly without any process. The step 164 counts up the cage No. k by "1", and the step 165 decides whether or not the processes have ended for all the cages. If they have not ended yet, the control flow returns to the step 162 again, and similar processes are executed as to the next cage No. k. When the processes have ended for all the cages, the control flow proceeds to a step 166 at which the assignment data AS(y, $I_O$) is set to "1" to the end of regularly allotting the hall call to be allotted $I_O$ to the cage y having the minimum assignment estimation value. At a step 167, the hall call data HC($I_O$) is set to "2" to the end of indicating that the hall call $I_O$ has been allotted. Then, the process of the assigned cage selection program block 46 ends.

Assuming that the assignment estimation values EV($K_O$) ($K_O$=1, 2, 3) be calculated, for example, as in Table 5 under the circumstances illustrated in FIG. 17, the up call of the fifth floor 5uH is regularly allotted to the cage No. 1 having the minimum assignment estimation value by the assigned cage selection program block 46.

When the process of the assigned cage selection program block 46 has ended, the assignment data items AS(k, i) (k=1, 2, 3; i=1, 2, . . . , 14) set by the calculations of this time are subsequently delivered to the cage controllers 9A–9C through the output circuit 26 in the output program of the program block 47 in FIG. 7. Then, the processes in the current calculation cycle end.

In this manner, according to the present embodiment, the program blocks 31–47 are repeated cyclically (one cycle=1 second) to perform arithmetic processing, whereby the allotments of hall calls are controlled.

As explained above, according to the embodiment of this invention, the group supervisory apparatus is implemented by means including a microcomputer operating under program control such that, when a hall call has been registered anew, the predicted waiting time of all hall calls in the case of tentatively allotting the new hall call to respective cages and the mean values and variances of the predicted waiting time are calculated, the square values of the differences between a preset long wait reference value and the mean values are obtained, the values of the ratios between the variances and the square values are calculated as assignment estimation values, and a cage is assigned on the basis of a minimum estimation value which minimizes the rate of occurrence of long waiting times of the passengers after registering hall calls.

Further, the long wait reference value is automatically altered depending upon time zones, so that hall call allotments corresponding to the traffic volumes of the respective time zones are done, and the rate of occurrence of long waits can be reduced more. Besides, the long wait reference value can be readily corrected by the manipulation of a correction switch upon the judgement of a person in charge, so that even when the traffic volumes of the respective time zones have changed temporarily (for example, on Sundays and holidays) or have changed over a long term (for example, due to the transfer of tenants from a building), reduction in the rate of occurrence of long waits can be achieved according to the changes of the traffic volumes.

Still further, the time zones can be readily corrected by the manipulation of a time zone setting switch upon the judgement of the person in charge, so that even when the start times of the time have fluctuated on account of the temporary change or long-term change of the flow of traffic, the fluctuations can be properly coped with.

Figure 9:
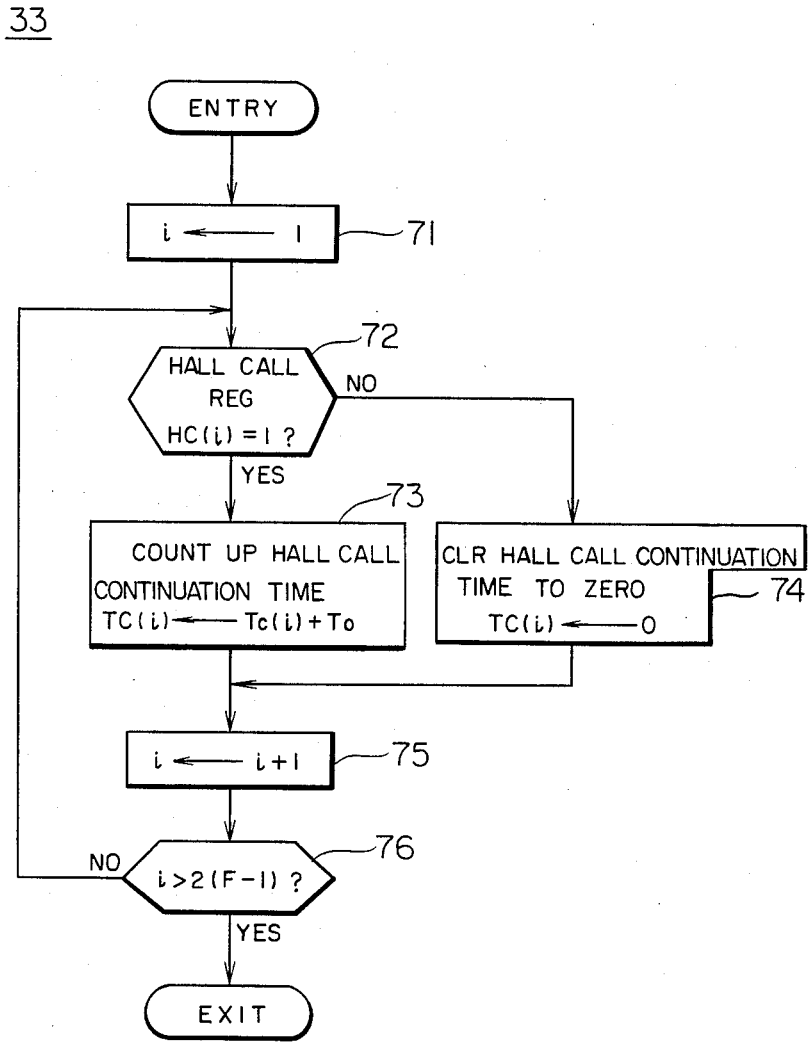
Figure 10:
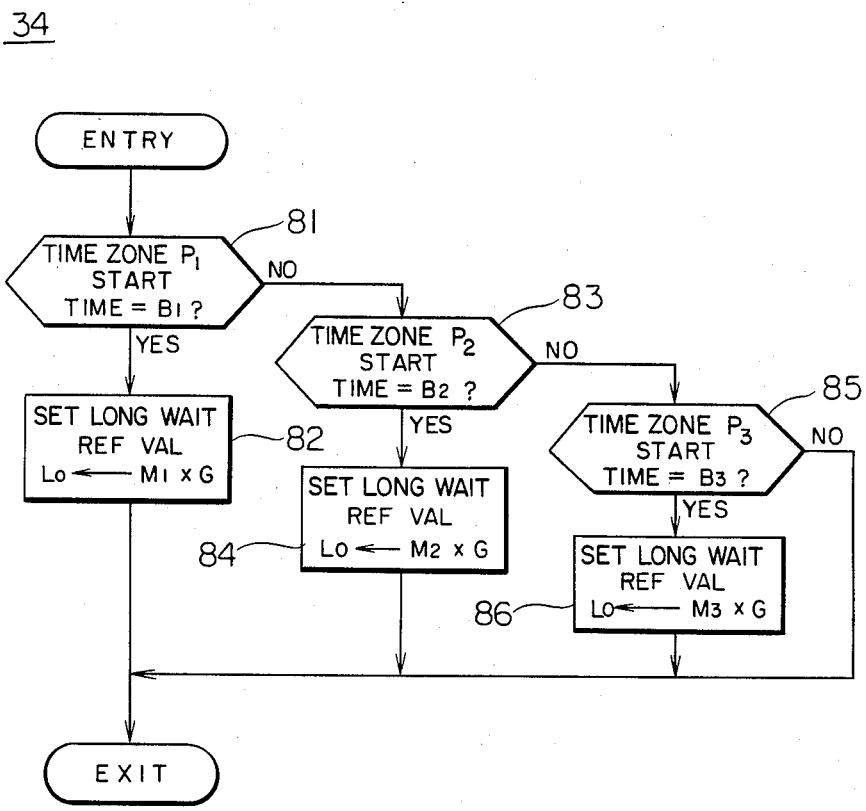
Figure 11:
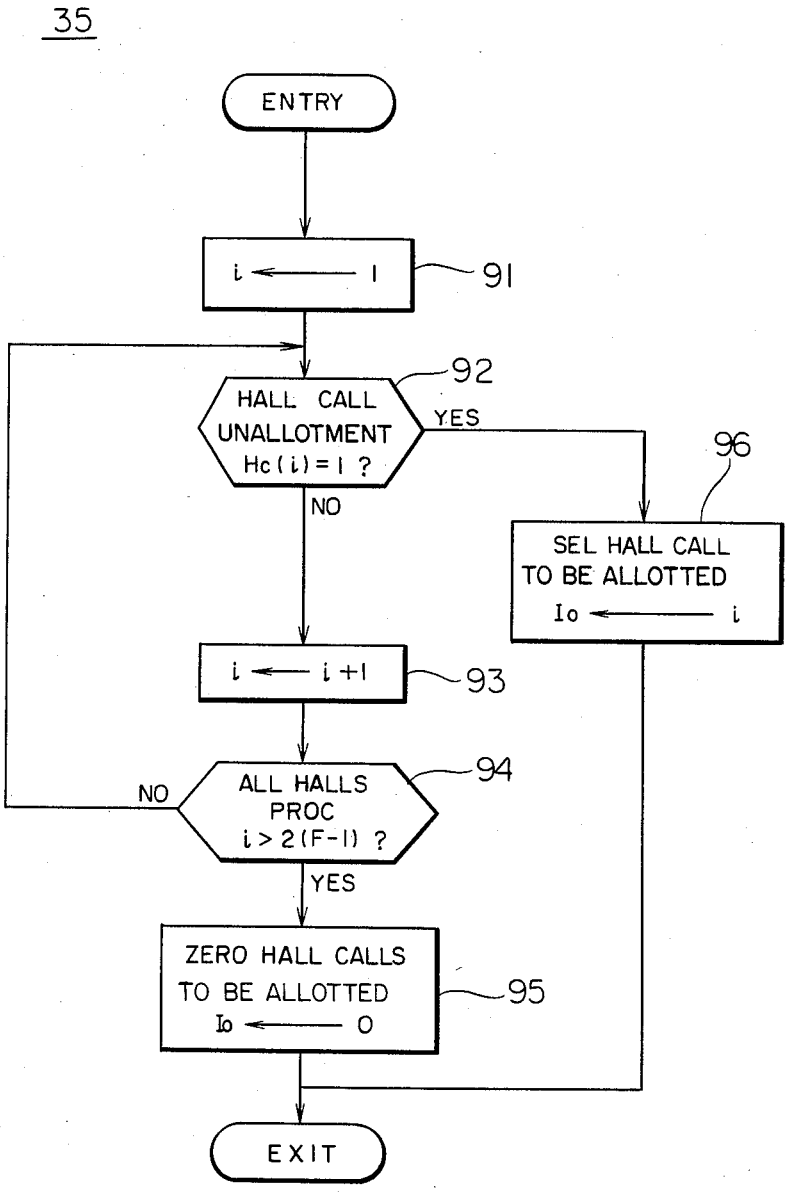
Figure 12:
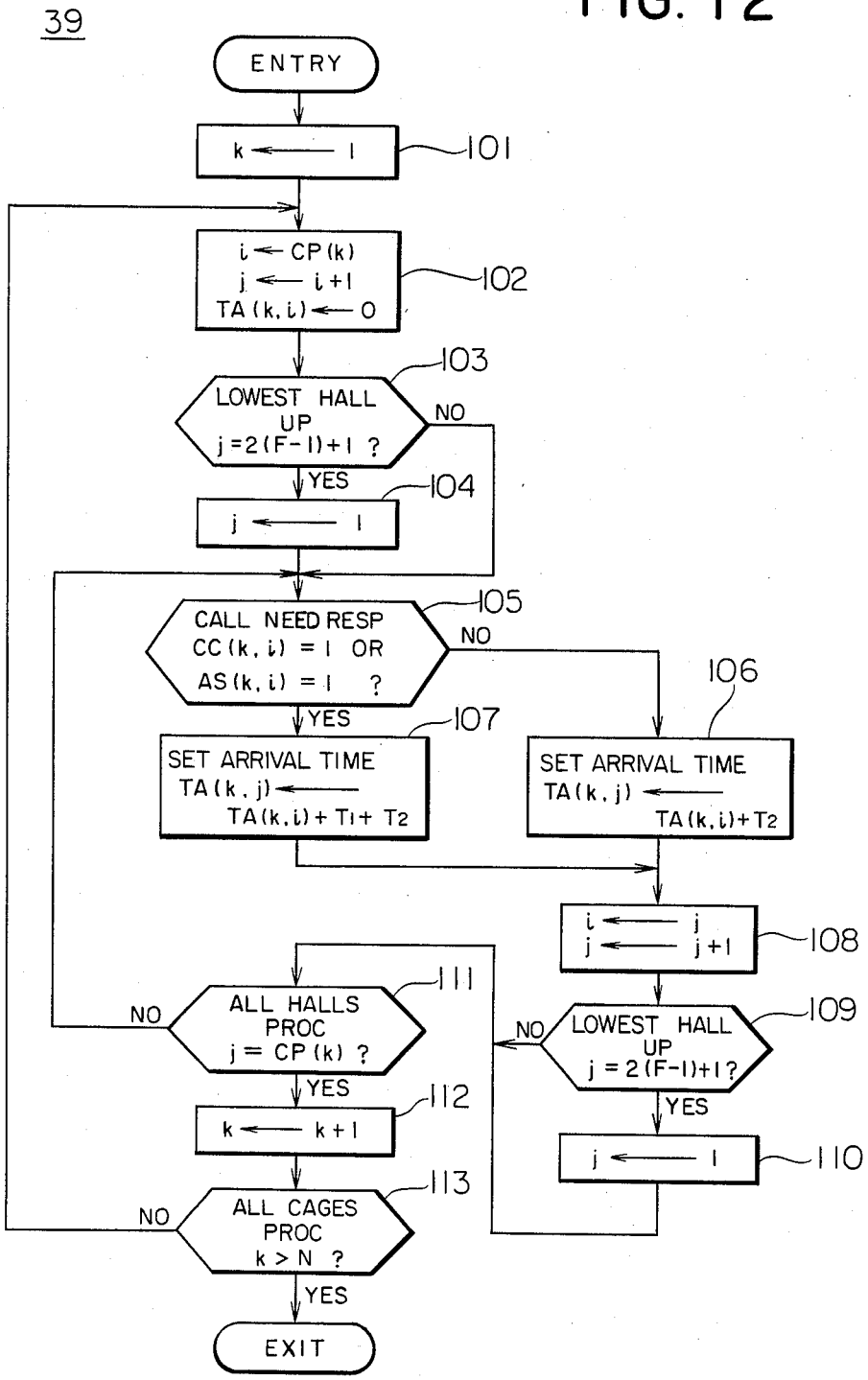
Figure 13:
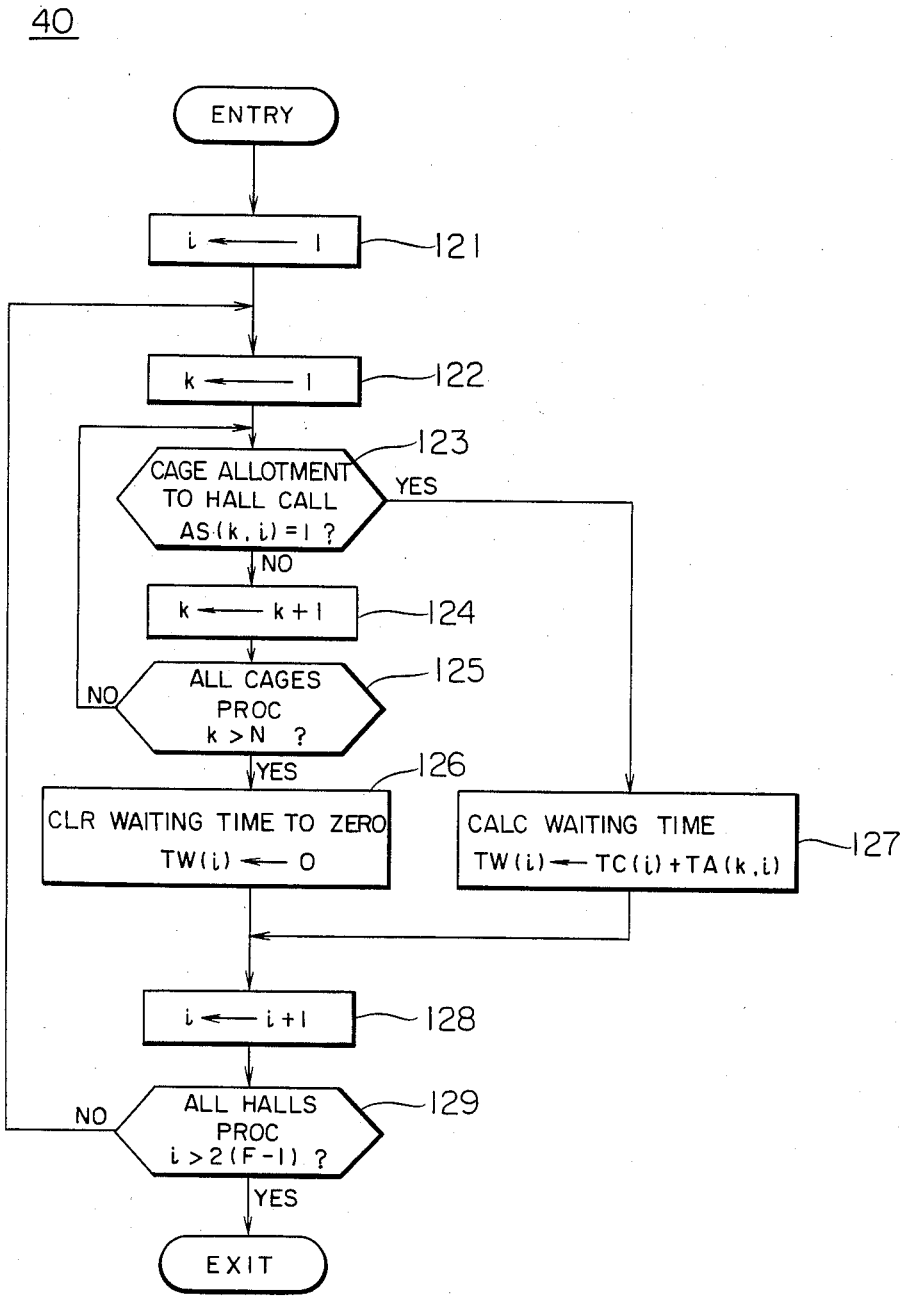
Figure 14:
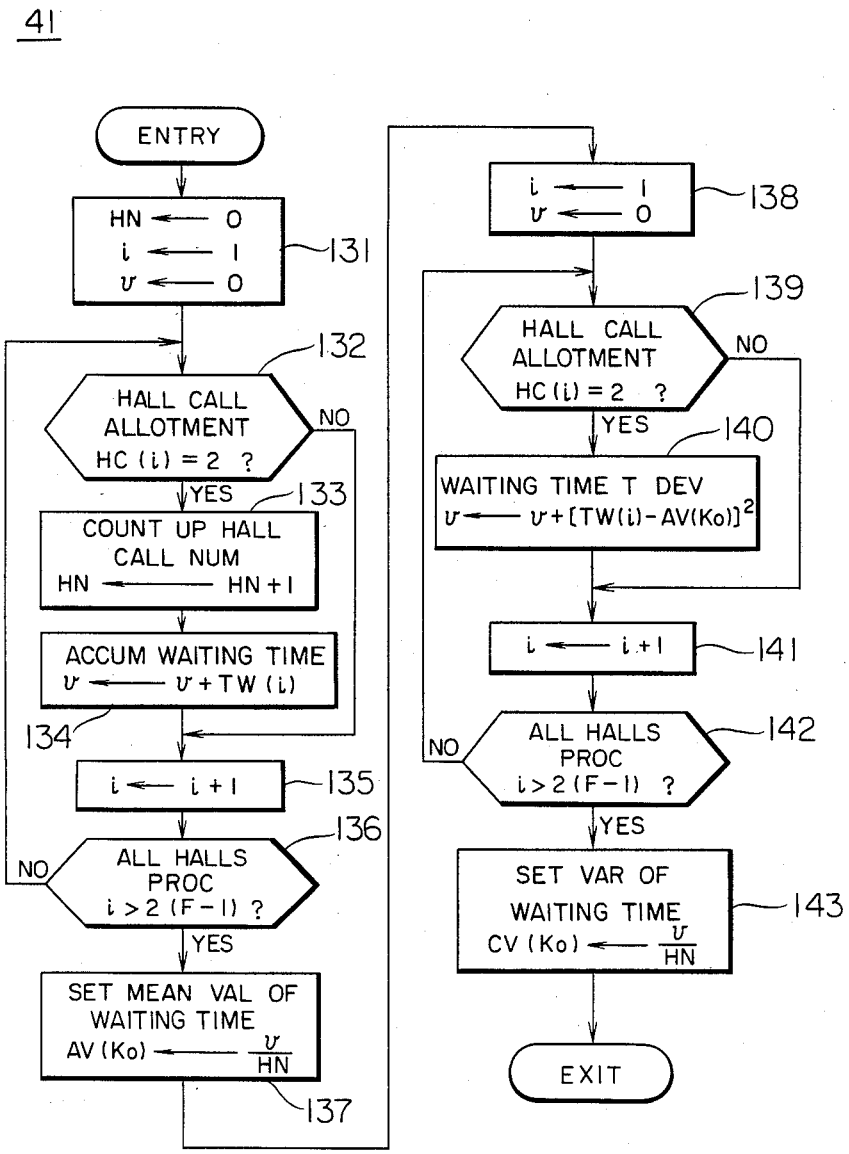
Figure 19:
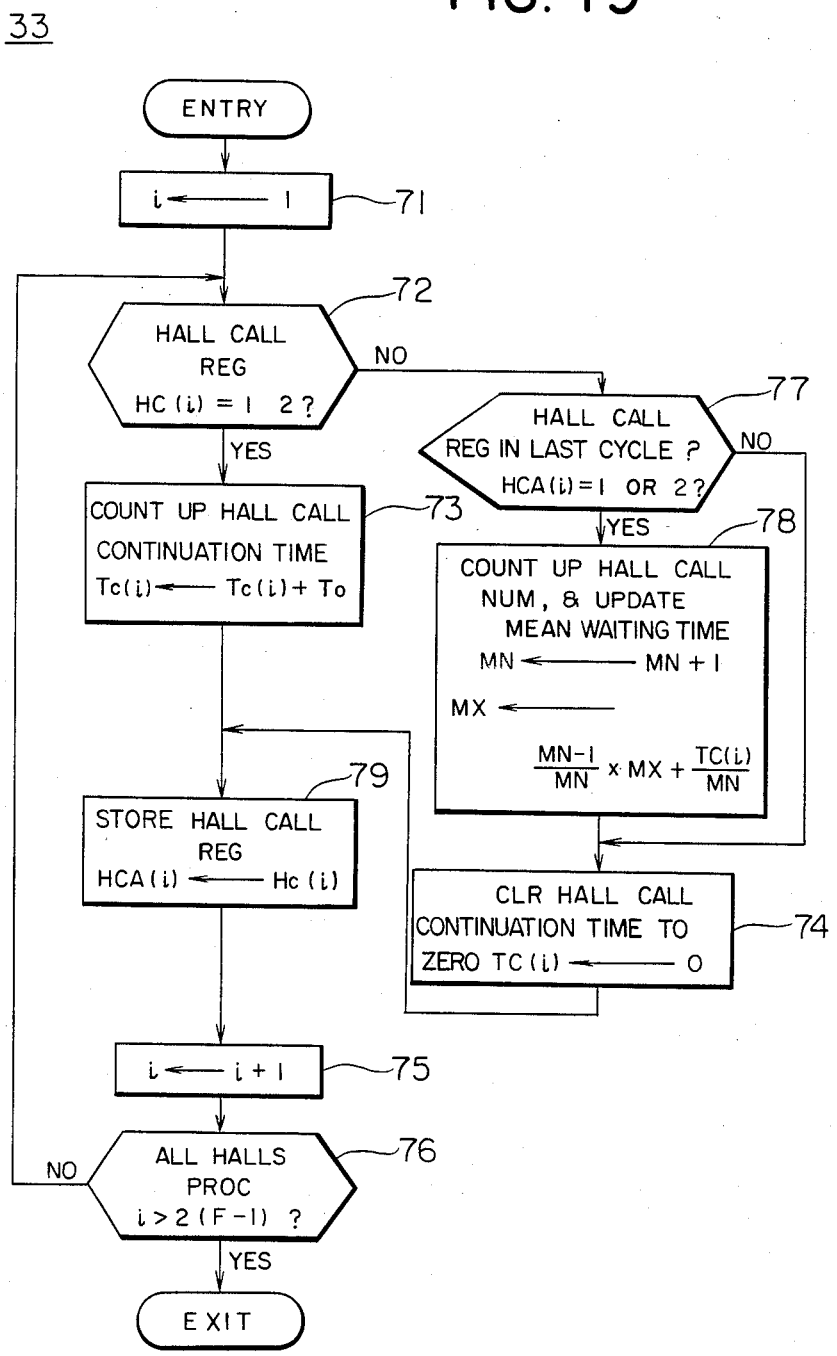
Figure 20:
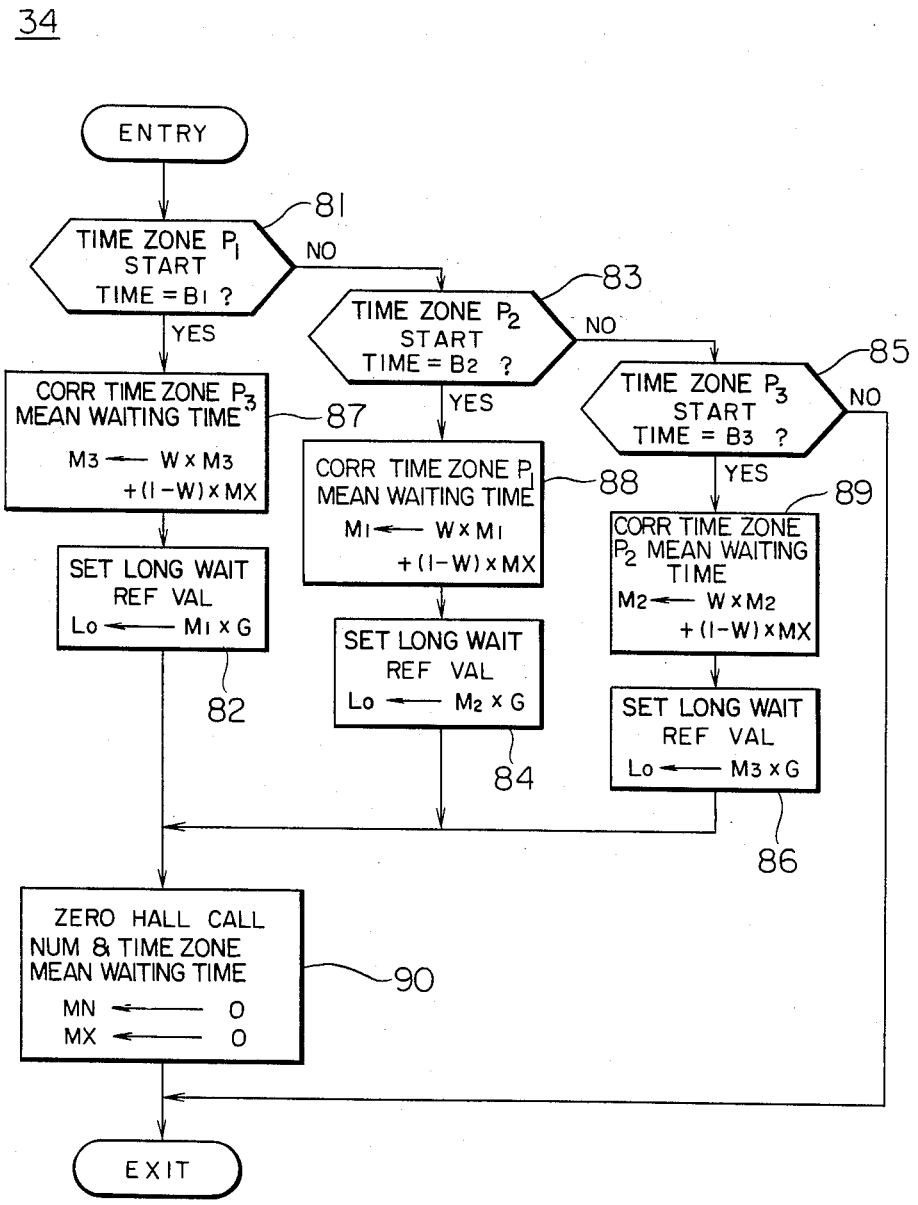

FIGS. 18–20 show another embodiment according to this invention, in which FIG. 18 shows memory maps corresponding to those of FIG. 5 in the first embodiment, FIG. 19 is a flow chart of a hall call continuation time calculation program 33 similarly corresponding to FIG. 9, and FIG. 20 is a flow chart of a long wait reference value setting program 34 similarly corresponding to FIG. 10. The others are the same as in the first embodiment.

First, data items in the memory maps of FIG. 18 differing from those of the first embodiment will be described. In the figure, HCA(i) (i=1, 2, . . . , 14) denotes hall call data which stores the hall call data HC(i) (i=1, 2, . . . , 14) in the immediately preceding calculation cycle, MN denotes data which expresses the number of hall calls registered in each of the time zones $P_1$–$P_3$, and MX denotes data which expresses the mean value of the actually measured values of waiting time in each of the time zones $P_1$–$P_3$. Data items $M_1$–$M_3$ express the extimated values of the mean waiting time in the time zones $P_1$–$P_3$ respectively as in the first embodiment. However, they differ from those of the first embodiment in that they are not input from the long wait reference value correction switch 20, but that they are set by automatic estimation from the actually measured values of the waiting periods of time as will be described later. W denotes data which is input from the long wait reference value correction switch 20. It serves to determine the weighting of the estimated value till the preceding day and the mean value of the waiting periods of time measured anew when each of the estimated values $M_1$–$M_3$ of the mean waiting periods of time is updated, and it can be set to an arbitrary value which is greater than 0 and is smaller than 1.

In the hall call continuation time calculation program block 33 of FIG. 19, different from FIG. 9 in the first embodiment is that steps 77–79 are added anew. When the step 72 decides that a hall call has not been registered (HC(i)≠1 and HC(i)≠2), and it is followed by the step 77, the situation of hall call registration in the preceding calculation cycle is decided here. If a hall call was registered in the preceding calculation cycle (HCA(i)=1 or HCA(i)=2), it is expressed that the hall call of hall No.i was responded to by a cage and was cancelled immediately before. Therefore, the control flow proceeds to the step 78, at which the hall call number data MN is counted up by "1", and the mean value MX of the waiting periods of time is updated in conformity with an equation, $$\frac{MN-1}{MN}\cdot MX+\frac{TC(i)}{MN}.$$

At the step 74, the hall call continuation time TC(i) is set to "0" as in the first embodiment. If a hall call was not registered in the preceding calculation cycle, either (HCA(i)≠1 and HCA(i)≠2), the step 77 is directly followed by the step 74, at which the hall call continuation time TC(i) is set to "0". At the step 79, the hall call data HC(i) is set as the hall call data to be stored HCA(i) in order to detect that a hall call was cancelled immediately before.

In this manner, the hall call continuation time calculation program block 33 calculates the mean value MX of the waiting time actually measured in each time zone, in addition to the continuation periods of time TC(i) (i=1, 2, . . . , 14) of hall calls.

In the long wait reference value setting program block 34 of FIG. 20, different from FIG. 10 in the first embodiment is that steps 87–90 are added anew.

When the time is the start time of the time zone $P_1$ (TIME=$B_1$) at the step 81, the control flow proceeds to the step 87, at which the estimative value $M_3$ of the mean waiting time in the time zone $P_3$ is updated.

More specifically, since (the start time of the time zone $P_1$)=(the end time of the time zone $P_3$) holds, the mean value MX of the waiting time represents the mean value in the time zone $P_3$. Assuming that the estimative value $M_3$ based on the measured values of the waiting time till the preceding day be 5 seconds, that the mean value MX measured this time be 6 seconds, and that the weighting data W be set as 0.8, then the new estimated value $M_3$ is calculated as $0.8\times5+6\times(1-0.8)=5.2$ seconds. Subsequently, at the step 82, the long wait reference value $L_O$ is set as in the first embodiment, and at the step 90, the hall call number data MN and the mean waiting time MX are respectively set to "0" for calculations in the next time zone.

At the start times of the other time zones $P_2$ and $P_3$, the estimated values $M_1$ and $M_2$ of the mean waiting time are similarly updated at the steps 88 and 89 respectively.

In this manner, the long wait reference value setting program block 34 sets the long wait reference values $L_O$ on the basis of the mean values of the waiting time actually measured in the respective time zones.

As explained above, according to the second embodiment of this invention, waiting time in each of time zones are actually measured, the mean waiting time is estimated for each time zone by the use of the actually measured values, and a long wait reference value is automatically corrected to as appropriate value on the basis of the estimated mean waiting time. Therefore, even when the traffic volume of each time zone has changed on a certain day for any reason, the rate of occurrence of long waits can be reduced without troubling a person in charge.

FIGS. 21–24 show a third embodiment according to this invention, and illustrate another embodiment of the assignment estimation function for estimating the rate of occurrence of long waits.

Figure 21:
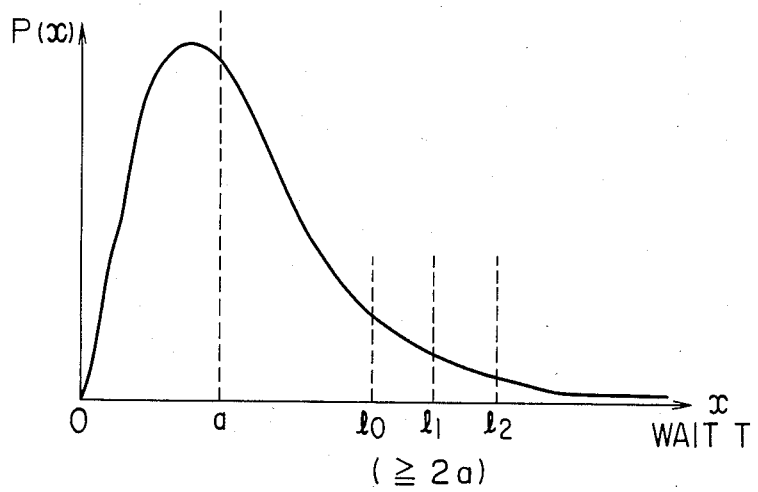

FIG. 21 shows an example of the distribution of the waiting time of hall calls, in which a denotes a mean value, and $l_O$, $l_1$ and $l_2$ denote long wait reference values unequal to one another, subject to $l_2>l_1>l_0\geqq 2a$.

In order to minimize the rate of occurrence of long waits $$\int_{l_0}^{\infty} p(x)dx$$

with respect to the long wait reference value $l_O$ and simultaneously to finely control the distribution of hall calls whose waiting time exceed the long wait reference value $l_O$, this embodiment minimizes the rate of occurrence of long waits L according to which a region $[l_O\infty]$ is divided into three regions $[l_O, l_1]$, $[l_1, l_2]$ and $[l_2, \infty]$ and the probabilities $$\int_{l_0}^{l_1} p(x)dx, \quad \int_{l_1}^{l_2} P(x)\mathrm{dx} \text{ and } \int_{l_2}^{\infty} p(x)dx$$

of the respective regions are linearly combined by plus numbers $q_0$, $q_1$ and $q_2$ ($q_2\geqq q_2\geqq q_0$), that is, $$L = q_0 \int_{l_0}^{l_1} p(x)dx + q_1 \int_{l_1}^{l_2} p(x)dx + q_2 \int_{l_2}^{\infty} p(x)dx \quad (10)$$

The above equation (10) can be further expanded as:

$$L = q_0 \int_{l_0}^{\infty} p(x)dx + (q_1 - q_0) \int_{l_1}^{\infty} p(x)dx + (q_2 - q_1) \int_{l_2}^{\infty} p(x)dx \quad (11)$$

When the inequality (6) is applied to this, the following formula (12) holds:

$$L \leqq \frac{q_0 \cdot b^2}{(l_0 - a)^2} \quad \frac{(q_1 - q_0) \cdot b^2}{(l_1 - a)^2} \quad \frac{(q_2 - q_1) \cdot b^2}{(l_2 - a)^2} \quad (12)$$

In this embodiment, accordingly, the right-hand side of the inequality (12) is adopted as the assignment estimation function f:

$$f = \frac{q_0 \cdot b^2}{(l_0 - a)^2} \quad \frac{(q_1 - q_0) \cdot b^2}{(l_1 - a)^2} + \frac{(q_2 - q_1) \cdot b^2}{(l_2 - a)^2} \quad (13)$$

in order to minimize the rate of occurrence of long waits L of the above equation (10).

Figure 15:
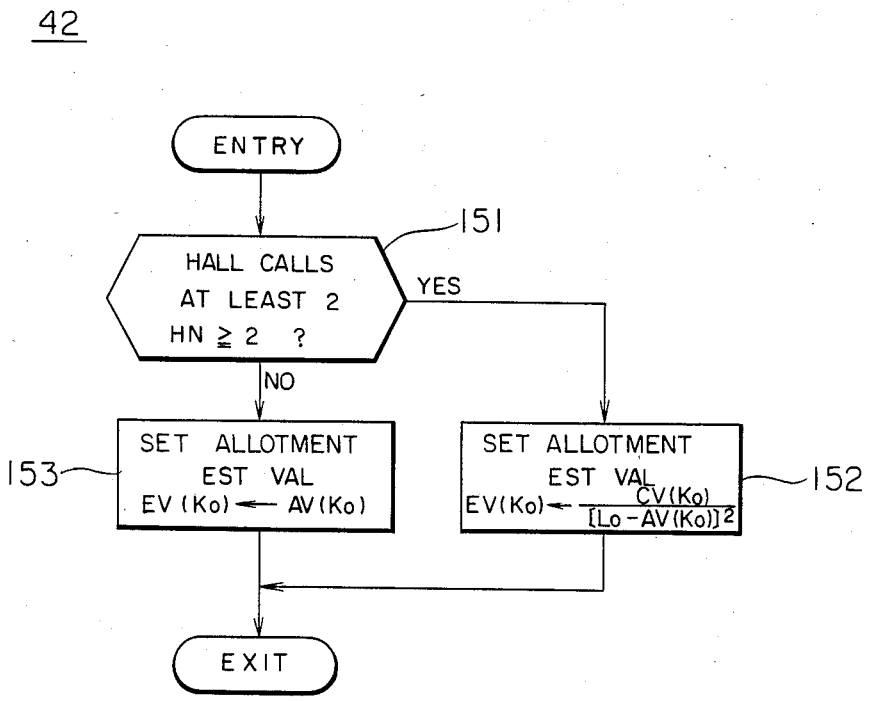
Figure 16:
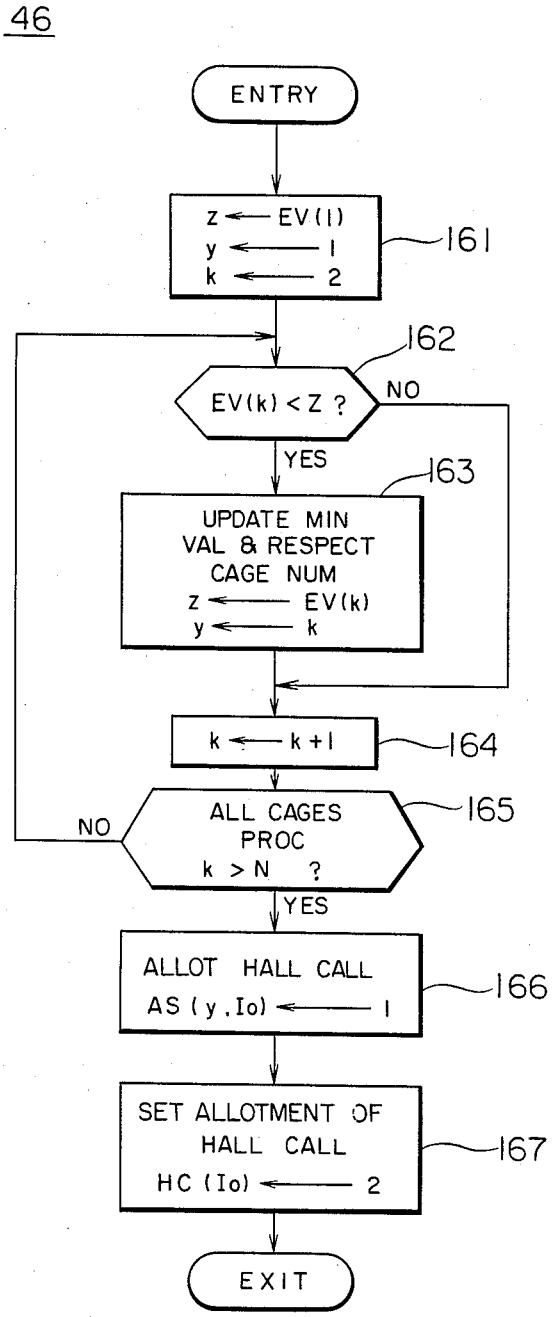
Figure 23:
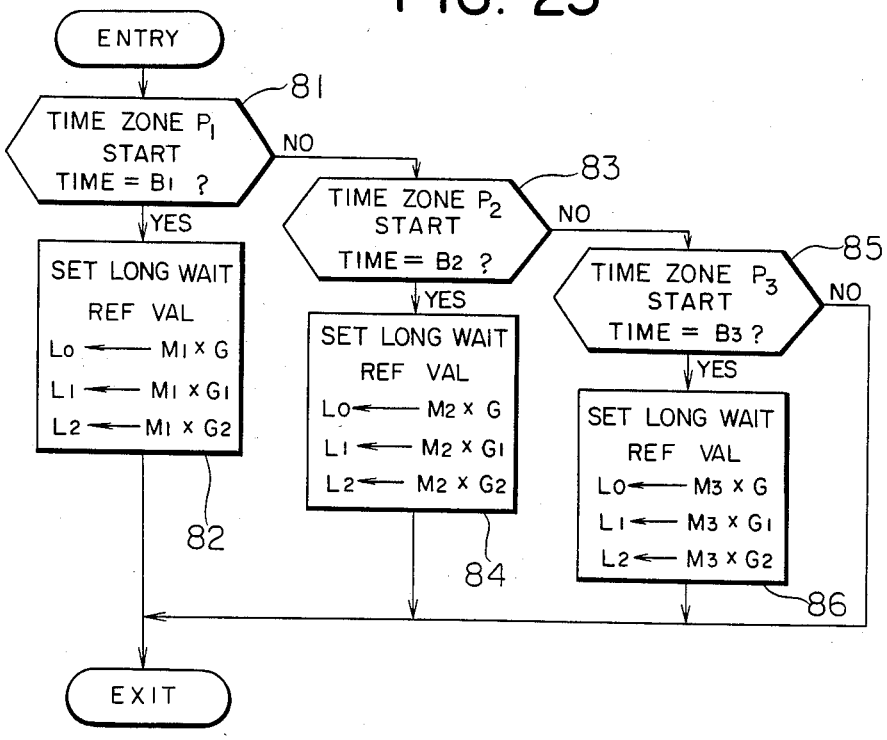
Figure 24:
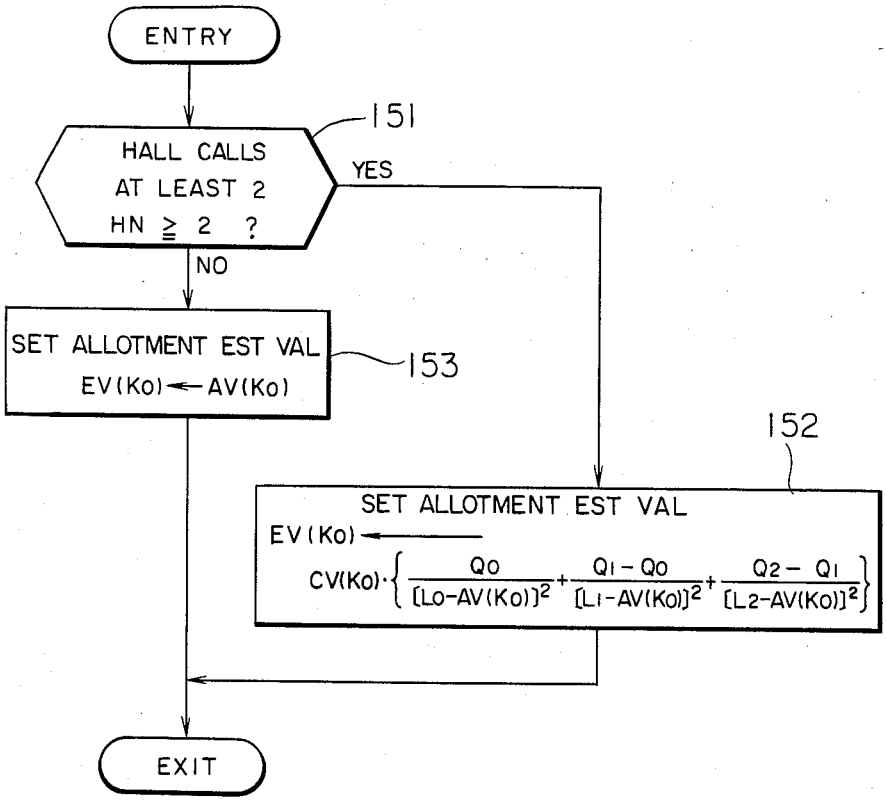

FIG. 22 shows memory maps corresponding to those of FIG. 5 in the first embodiment, FIG. 23 is a flow chart of a long wait reference value setting program block 34 similarly corresponding to FIG. 10, and FIG. 24 is a flow chart of an assignment estimation value calculation program block 42 similarly corresponding to FIG. 15. The others are the same as in the first embodiment.

First, data items in the memory maps of FIG. 22 differing from those of the first embodiment will be described.

In the figure, $L_1$ and $L_2$ denote data items which express long wait reference values corresponding to $l_1$ and $l_2$ in FIG. 21 respectively, and $G_1$ and $G_2$ denote denote input data items which are applied from the long wait reference value correction switch 20 and which express coefficients for setting the long wait reference values $L_1$ and $L_2$ on the basis of mean waiting periods of time. $Q_0$–$Q_2$ denote fixed value data items which correspond respectively to $q_0$–$q_2$ in the assignment estimation function f expressed by Eq. 13 and which are respectively set as '1', '2' and '4'. The others are the same as in the first embodiment.

In the long wait reference value setting program 34 of FIG. 23, different from FIG. 10 in the first embodiment are steps 82, 84 and 86, at each of which the calculations of the long wait reference values $L_1$ and $L_2$ are added. Likewise to the long wait reference value $L_0$, the long wait reference values $L_1$ and $L_2$ are set in such a way that the estimated values $M_1$–$M_3$ of the mean waiting periods of time are respectively multiplied by the coefficients $G_1$ and $G_2$.

In the assignment estimation value calculation program block 42 of FIG. 24, different from FIG. 15 in the first embodiment is a step 152, at which the setting of the assignment estimation value $EV(K_0)$ is calculated in conformity with the assignment estimation function f expressed by Eq. 13 .

Assuming now that the estimated value $M_2$ of the mean waiting time in the time zone $P_2$ be set as 20 (seconds) and that the coefficients G, $G_1$ and $G_2$ be respectively set as 3, 4 and 5, then the long wait reference values $L_0$, $L_1$ and $L_2$ are respectively set as $20\times3=60$ (seconds), $20\times4=80$ (seconds) and $20\times5=100$ (seconds) at the step 84 of the long wait reference value setting program block 34. On this occasion, in a case where the up call of the fifth floor 5uH is allotted under the circumstances illustrated in FIG. 17, the step 152 of the assignment estimation value calculation program 42 in FIG. 24 calculates the respective assignment estimation values $EV(K_0)$ ($K_0=1, 2, 3$) as follows, on the basis of the mean values $AV(K_0)$ and variances $CV(K_0)$ ($K_0=1, 2, 3$) indicated in Table 5, the long wait reference values $L_0$, $L_1$ and $L_2$ mentioned above, and the fixed values $Q_0$ (=1), $Q_1$ (=2) and $Q_2$ (=4).

$$EV(1) = \frac{1\times71.55}{(60-22.7)^2} + \frac{(2-1)\times71.55}{(80-22.7)^2} + \frac{(4-2)\times71.55}{(100-22.7)^2} = 0.0969$$

$$EV(2) = \frac{1\times133.96}{(60-22.4)^2} + \frac{(2-1)\times133.96}{(80-20.4)^2} + \frac{(4-2)\times133.96}{(100-20.4)^2} = 0.1654$$

$$EV(3) = \frac{1\times218.29}{(60-27)^2} + \frac{(2-1)\times218.29}{(80-27)^2} + \frac{(4-2)\times218.29}{(100-27)^2} = 0.3601$$

Accordingly, the up call of the fifth floor 5uH is allotted to the cage No. 1 of the minimum assignment estimation value $EV(K_0)$ by the assigned cage selection program block 46.

As explained above, according to the third embodiment of this invention, when a hall call has been registered anew, the predicted waiting time of all hall calls in the case of tentatively allotting the new hall call to respective cages and the mean values and variances of the predicted waiting time are calculated, the square values of the differences between the mean values and a plurality of long wait reference values previously set are respectively obtained, the values of the ratios between the variances and the square values are respectively weighted by plus values and then added to calculate assignment estimation values, and the cage whose assignment estimation value becomes a minimum is caused to respond to the hall call registered anew. Therefore, the rate of occurrence of long waits of the hall calls can be reduced, while at the same time the situations of the distributions of occurrence of long wait calls can be balancedly controlled in accordance with the weighting.

While the third embodiment has referred to the case where the number of long wait reference values is set to 3, the number of long wait reference values is not restricted thereto. As the number of long wait reference values is increased more, the distribution of the occurrence of long wait calls can be controlled more finely.

While the weighting values $Q_0$, $Q_1$ and $Q_2$ have been set in the ROM 23, this is not restrictive, but it is also possible to set the values at will by means of a switch similar to the correction switch 20. This measure makes it possible to finely control the distribution of the occurrence of long wait calls in accordance with traffic volumes upon the judgement of a person in charge or the like.

Assignment estimation values have been calculated using $$f = \frac{b^2}{(l_o - a)^2}$$

of Eq. 7 as an assignment estimation function in the first and second embodiments and using $$f = \frac{q_0\cdot b^2}{(l_0-a)^2} \quad \frac{(q_1-q_0)\cdot b^2}{(l_1-a)^2} + \frac{(q_2-q_1)\cdot b^2}{(l_2-a)^2}$$

of Eq. 13 as the same in the third embodiment, thereby to estimate the hall call allotments which minimize the rate of occurrence of long waits. However, the assignment estimation function for estimating the rate of occurrence of long waits is not restricted to the above ones. It is needless to say that similar effects are produced even when a function which is expressed by a monotonically increasing function of a ratio $$\frac{b^2}{(l-a)^2}$$

corresponding to an arbitrary long wait reference value l is adopted as the assignment estimation function.

It is also possible to perform hall call allotments by the use of an assignment estimation function in which the factor for estimating the rate of occurrence of long waits, namely, the ratio $$\frac{b^2}{(l-a)^2}$$

and other estimated factors are combined. By way of example, when an assignment estimated function in which an estimative factor for the rate of occurrence of long waits is combined with the probability of forecast missing and the probability of full capacity is employed as in a group supervision apparatus for an elevator described in Japanese Patent Application Laid-open No. 54-72833 wherein hall call allotments are done using an assignment estimation function in which waiting periods of time are combined with other service situations (the forecast missing probability, the full capacity probability), it becomes possible to balancedly reduce the rate of occurrence of long waits, the rate of forecast missing and the rate of occurrence of full capacity.

Further, the respective embodiments calculate the assignment estimation values on the basis of the mean values and variances of the predicted waiting time, the mean value of the predicted waiting time becomes a large value in some situations of occurrence of hall calls, so it temporarily fails to satisfy the condition of (long wait reference value $\geqq 2\times$mean value). In such a case, the long wait reference value is temporarily set at a value large enough to meet the above condition, and the assignment estimation value is then calculated, whereby allotments based on the relation of the inequality (6) can be maintained.

Figure 25:
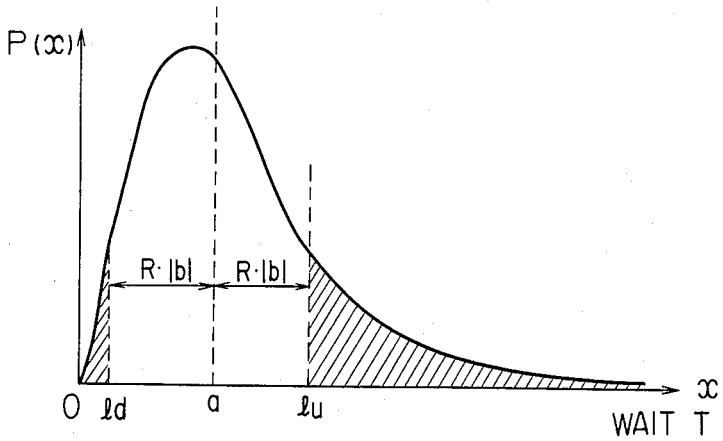
FIG. 25 is an explanatory diagram in the case of setting two sorts of reference values.

Further, the embodiments have been limited to the case where the condition of $R \geqq a/|b|$ is satisfied for the long wait reference value $l_0$ as indicated by Eq. (5), but a case of $R < a/|b|$ will now be considered. In a case where, as illustrated in FIG. 25, reference values $l_u$ and $l_d$ are set as $$l_u = a + R\cdot|b| \text{ (for } O<R<a/b) \quad (14)$$

$$l_d = a - R\cdot|b| \text{ (for } O<R<a/b) \quad (15)$$

for the distribution of the waiting time of hall calls, the probability of occurrence L (a value equivalent to the area of hatched parts in the figure) of hall calls whose waiting time lie in the regions $[O, l_d]$ and $[l_u, \infty]$ is expressed by the following equation (16):

$$L = 1 - \int_{l_d}^{l_u} p(x)dx \quad (16)$$

When the Tchebycheff inequality expressed by Eq. 4 is applied to the above equation, the relationship pf $$\left.\begin{aligned} L \leqq \frac{1}{R^2} &= \frac{b^2}{(l_u - a)^2} \\ &= \frac{b^2}{(a - l_d)^2} \end{aligned}\right\} \quad (17)$$

holds likewise to Eq. (6).

The right-hand side $$\frac{b^2}{(l_u - a)^2} \text{ or } \frac{b^2}{(a - l_d)^2}$$

of this equation (17) is to be called the 'upper limit value of the probability L of the above equation (16)'. Accordingly, when the arbitrary reference value $l_u$ or $l_d$ meeting Eq. (14) or Eq. (15) is given, hall call allotments are performed so as to afford the mean value a and the variance $b_0^2$ which minimize the upper limit value $$\frac{b^2}{(l_u - a)^2} \text{ or } \frac{b^2}{(a - l_d)^2};$$

whereby the maximization of the probability of the concentration of the waiting time in the region $[l_d, l_u]$, in turn, the minimization of the rate of occurrence of long waits can be achieved. In this case, the assignment estimation function f for estimating the rate of occurrence of long waits is set as:

$$f = \frac{b^2}{(l_u - a)^2} \quad 18$$

$$f = \frac{b^2}{(a - l_d)^2} \quad 19$$

This can be realized similarly to the first embodiment because the long wait reference value $l_0$ may be merely replaced with the reference value $l_u$ or $l_d$ in the first embodiment.

Other Embodiments of Means to set Long Wait Reference Value:

(i) In the first embodiment, the estimated values $M_1$–$M_3$ of the mean waiting time are designated by the correction switch 20, and in the second embodiment, the estimated values $M_1$–$M_3$ are set on the basis of the waiting time actually measured every day, and further, the coefficient G is designated by the correction switch 20, whereupon the long wait reference values $L_0$ are set in terms of the products between the estimated values and the coefficient. However, the long wait reference values $L_0$ may well be designated directly by the correction switch 20. Besides, even when the estimated values, coefficient and long wait reference values are set as fixed data in the ROM 23, the effects of this invention are not degraded.

(ii) In the first embodiment, one day is divided into the three time zones $P_1$–$P_3$, for which the long wait reference values $L_0$ are set. However, the way of dividing the of time zones is not restricted thereto. Time zones finely divided, such as of every hour or every 30 minutes, may well be employed, and it is also considered to set time zones according to traffic volumes (in individual directions).

(iii) In the respective embodiments, the long wait reference value $L_0$ is altered only at the start time of each time zone, but the timing at which the long wait reference value $L_0$ is altered is not restricted thereto. For example, this reference value may well be set every calculation period $T_0$.

Other Embodiments of Means to calculate Predicted Waiting Time:

In the respective embodiments, the expected arrival time are calculated assuming that a cage be operated through all floors and require 10 seconds for one stop and 2 seconds for one floor travel, and the predicted waiting time are calculated on the basis of the expected arrival time and the continuation periods of time of hall calls. However, the way of calculating the predicted waiting time is not restrictive thereto.

How to calculate the predicted waiting time has been proposed in Japanese Patent Application Laid-open No. 50-149041 mentioned before. It is also easy to apply calculation methods with various improvements made therein, for example, methods of calculating the expected arrival time more precisely, such as a method which predicts cage calls to be registered after response to a hall call, a method which predicts the direction invention of a cage at an intermediate floor, and a method which calculates assuming that a cage having no call go through.

While, in each of the embodiments, this invention has been applied to the case where a hall registered anew is selected as a hall call to be allotted and where it is allotted to a cage, a hall call allotment is not restricted thereto. This invention is also applicable to an allotment alteration system wherein the allotment of a hall call is once cancelled and a hall call allotment is done anew under a predetermined condition as in a case where, even in the presence of a hall call already allotted, a hall call which might lead to a long wait by way of example has been detected or where the allotments of hall calls are reviewed each time a fixed time has lapsed, or to a system wherein a supporting cage is additionally assigned to a hall call whose service has worsened.

While, in each of the embodiments, the service time has been the waiting time of a hall call, the former is not restricted to the latter. By way of example, the continuation time of a cage call is calculated similarly to that of a hall call by employing the cage call data CC(k, i) ($k=1, 2, 3$; $i=1, 2, \ldots, 14$) instead of the hall call data HC(i) ($i=1, 2, \ldots, 14$), this continuation period of time and the expected arrival time data TA(k, i) ($k=1, 2, 3$; $i=1, 2, \ldots, 14$) to a hall where the cage call exists are added, to obtain the predicted value of a service time for the cage call, and this predicted value can be used as the predicted service time corresponding to the predicted value of a riding time. It is also easy that the predicted value of the service time for the cage call and the predicted waiting time of a hall call are added and that the added value is used as the predicted service time corresponding to a service completion time.

As described above, this invention comprises means to predict time of service by respective cages and to calculate predicted service time, means to calculate a mean value and a variance of the predicted service time as to each of the cages, means to set a reference value for deciding whether the service time are long or short, means to obtain a square value of a difference between the reference value and the mean value, to calculate a value of a ratio between the variance and the square value and to calculate an assignment estimation value on the basis of the value of the ratio in conformity with a predetermined assignment estimation function which becomes a monotonically increasing function of the ratio, and means to preferentially select a cage as to which the assignment estimation value is smaller and to assign the selected cage to a hall call. Therefore, it has the effect of reducing the rate of occurrence of long waits of service time by an elevator.

What is claimed is:

1. In an elevator wherein hall buttons are disposed for hall call registration in halls for a plurality of floors served by a plurality of cages, a group supervision apparatus comprising means to tentatively allot the registered hall calls to respective cages and calculate, based on the tentative cage allotments, predicted service times required for the allotted cage to serve passengers, the predicted service times including riding times, service completion times, and waiting times of passengers, mean value and variance calculation means to calculate a mean value and a variance of the predicted service times for each of the tentative cage allotments, means to set a reference time value on the basis of the predicted service times, means to find a square value of a difference between the reference time value and the mean value of the predicted service times and calculate a ratio of the variance relative to the square value corresponding to each of the tentative cage allotments and further to convert the calculated ratio in accordance with a predetermined assignment estimation function which is monotonically increasing so as to calculate an assignment estimation value for each of the cage allotments, and selection means to assign a cage to serve the passengers on the basis of the assignment estimation values which minimize rate of occurrence of long waiting times.

2. A group supervision apparatus for an elevator according to claim 1, wherein said reference time value setting means comprises an externally operable switch.

3. A group supervision apparatus for an elevator according to claim 1, wherein said reference time value setting means sets the reference time value on the basis of a service time actually measured.

4. A group supervision apparatus for an elevator according to claim 1 wherein said predicted service time calculation means estimates a waiting time required for the alloted cage to respond to the registered hall calls and said reference time value setting means sets the reference time value on the basis of the predicted service times.

5. A group supervision apparatus for an elevator according to claim 1 wherein the reference time value setting means sets a plurality of reference time values, and the assignment estimation value calculation means obtains the square value of the difference between the mean value of the predicted service times and each of said reference time values, calculates the ratio of the variance of the predicted service times relative to the square value corresponding to each of the tentative cage allotments, and calculates the assignment estimation values in accordance with a predetermined assignment estimation function which mnotonically increases.

* * * * *